US012195256B2

(12) United States Patent
Ford

(10) Patent No.: US 12,195,256 B2
(45) Date of Patent: Jan. 14, 2025

(54) CARRIER FOR CONTAINERS

(71) Applicant: Graphic Packaging International, LLC, Atlanta, GA (US)

(72) Inventor: Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/851,200

(22) Filed: Jun. 28, 2022

(65) Prior Publication Data

US 2022/0411155 A1 Dec. 29, 2022

Related U.S. Application Data

(60) Provisional application No. 63/216,062, filed on Jun. 29, 2021.

(51) Int. Cl.
*B65D 71/20* (2006.01)
*B65D 71/32* (2006.01)
*B65D 71/44* (2006.01)

(52) U.S. Cl.
CPC ..... *B65D 71/20* (2013.01); *B65D 71/32* (2013.01); *B65D 71/44* (2013.01);
(Continued)

(58) Field of Classification Search
CPC ..... B65D 71/20; B65D 71/32; B65D 71/44; B65D 71/42; B65D 2571/0016;
(Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
AU 2009200835 A1 9/2009
(Continued)

OTHER PUBLICATIONS

"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).
(Continued)

*Primary Examiner* — Andrew D Perreault
(74) *Attorney, Agent, or Firm* — Womble Bond Dickinson (US) LLP

(57) ABSTRACT

A carrier for holding a plurality of containers, the carrier including a plurality of panels having at least one attachment panel configured to receive a portion of one or more containers of the plurality of containers, at least one side panel, and at least one top panel, and locking features for maintaining an erected configuration of the carrier, the locking features including at least one male locking feature extending from a respective panel of the plurality of panels being at least partially received in a respective at least one female locking feature at least partially defined in a respective panel of the plurality of panels.

72 Claims, 15 Drawing Sheets

(52) U.S. Cl.
CPC ..... *B65D 2571/0016* (2013.01); *B65D 2571/00277* (2013.01); *B65D 2571/00444* (2013.01); *B65D 2571/0066* (2013.01)

(58) Field of Classification Search
CPC ..... B65D 2571/00277; B65D 2571/00444; B65D 2571/0066; B65D 71/40
USPC ..... 206/434
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A * 3/1956 Toensmeier ..... B65D 71/48 53/48.5
2,798,603 A 7/1957 Grinspoon
2,814,385 A 11/1957 Stone
2,823,062 A 2/1958 Toensmeier
2,929,181 A 3/1960 Poupitch
2,936,070 A 5/1960 Poupitch
2,950,041 A 8/1960 Stone
2,965,410 A 12/1960 Hughes
3,001,647 A 9/1961 Liss
3,005,654 A 10/1961 Stone et al.
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
RE25,781 E 5/1965 Akiereb
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,310,334 A 3/1967 Murphy
3,317,234 A 5/1967 Burford
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,515,272 A 6/1970 Gal
3,528,697 A 9/1970 Wood
3,587,847 A 6/1971 Graser
3,601,253 A 8/1971 Poupitch
3,601,439 A 8/1971 Poupitch
3,612,266 A 10/1971 Graser
D222,579 S 11/1971 Oglesbee
3,627,121 A 12/1971 Deasy
3,653,503 A 4/1972 Arneson
3,653,504 A 4/1972 Saumsiegle
3,664,497 A 5/1972 Mascia
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,767,041 A 10/1973 Graser
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,078,357 A 3/1978 Ida
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
4,192,540 A 3/1980 Oliff
D257,001 S 9/1980 Oliff
4,244,617 A 1/1981 Manizza
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,518,081 A 5/1985 de Larosiere
4,523,676 A 6/1985 Barrash
4,566,591 A 1/1986 Turtschan
4,703,847 A 11/1987 Oliff
D294,331 S 2/1988 Panazzolo
4,736,977 A 4/1988 Killy
4,784,266 A 11/1988 Chaussadas
D304,017 S 10/1989 Oliff
4,911,288 A 3/1990 Dantoin, Jr.
4,911,289 A 3/1990 Bird
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,186,321 A 2/1993 Fadus
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,285,892 A 2/1994 Adami
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,320,216 A 6/1994 Pangborn
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,469,687 A 11/1995 Olson
5,474,172 A 12/1995 Zavatone et al.
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,542,536 A 8/1996 Sutherland

(56) References Cited

U.S. PATENT DOCUMENTS 5,551,566 A 9/1996 Sutherland
5,553,704 A 9/1996 Gordon et al.
5,553,705 A 9/1996 Bakx
5,573,111 A 11/1996 Gordon
5,590,776 A 1/1997 Galbierz
5,593,027 A 1/1997 Sutherland
5,609,247 A 3/1997 Appleton
5,609,251 A 3/1997 Harris
5,609,379 A 3/1997 Harrelson
5,627,150 A 5/1997 Peterson
5,639,137 A 6/1997 Bakx
5,682,982 A 11/1997 Stonehouse
5,706,936 A 1/1998 Bernstein
5,711,419 A 1/1998 Beales et al.
5,718,330 A 2/1998 Auffret et al.
5,735,394 A 4/1998 Harrelson
5,746,310 A 5/1998 Slomski
5,762,193 A 6/1998 Marco
5,791,463 A 8/1998 Negelen
5,791,464 A 8/1998 Galbierz et al.
5,816,391 A 10/1998 Harris
5,845,776 A 12/1998 Galbierz et al.
5,878,876 A 3/1999 Galbierz et al.
5,960,945 A 10/1999 Sutherland
6,039,181 A 3/2000 Whiteside
6,059,099 A 5/2000 Galbierz
6,082,532 A 7/2000 Miess
6,145,656 A 11/2000 Marco
6,168,012 B1 1/2001 Galbierz
6,293,392 B1 9/2001 Galbierz
6,315,111 B1 11/2001 Sutherland
6,394,272 B1 5/2002 Domansky
6,896,130 B2 5/2005 Theelen
D506,925 S 7/2005 Plumer
7,011,209 B2 3/2006 Sutherland et al.
7,048,113 B2 5/2006 Gomes
7,360,647 B2 4/2008 Ogg
7,690,507 B2 4/2010 Sutherland
7,721,878 B2 5/2010 Requena
7,762,397 B2 7/2010 Coltri-Johnson et al.
7,789,231 B2 9/2010 Requena
7,823,721 B2 11/2010 Sutherland et al.
7,913,844 B2 3/2011 Spivey, Sr.
8,056,709 B2 11/2011 Sutherland
8,096,413 B2 1/2012 Coltri De Paula
8,113,968 B2 2/2012 Fittler
8,162,135 B2 4/2012 Oliveira
8,353,398 B2 1/2013 DePaula et al.
8,387,784 B2 3/2013 Gonzalez et al.
8,443,968 B2 5/2013 DePaula
8,464,866 B2 6/2013 Sutherland et al.
8,469,184 B2 6/2013 Spivey, Sr.
8,602,209 B2 12/2013 Jones et al.
8,631,932 B2 1/2014 Holley, Jr.
8,701,878 B2 4/2014 Spivey, Sr.
8,925,720 B2 1/2015 Sutherland et al.
8,936,149 B2 1/2015 Smalley
8,955,674 B2 2/2015 Spivey, Sr. et al.
9,004,344 B2 4/2015 Smith
9,079,699 B2 7/2015 Holley, Jr.
9,169,050 B2 10/2015 Spivey, Sr.
9,284,090 B2 3/2016 Lettre
9,359,093 B2 6/2016 DePaula et al.
9,376,250 B2 6/2016 Spivey, Sr.
D767,408 S 9/2016 Shuster
9,446,891 B2 9/2016 Jones et al.
9,511,916 B2 12/2016 Holley, Jr.
D786,702 S 5/2017 Borg et al.
9,669,976 B2 6/2017 Kastanek et al.
9,676,535 B2 6/2017 Spivey, Sr.
10,077,131 B2 9/2018 Lettre
10,293,998 B2 5/2019 Borg et al.
D881,021 S 4/2020 Bandinu
D881,718 S 4/2020 Bandinu
10,836,550 B2 11/2020 Zacherle
D918,057 S 5/2021 L'Heureux
D918,058 S 5/2021 L'Heureux
11,014,727 B2 5/2021 McCree
D920,809 S 6/2021 Chesnet et al.
D921,493 S 6/2021 Chesnet
D923,416 S 6/2021 Luciano
11,027,904 B2 6/2021 McCree
11,027,905 B2 6/2021 Ford
11,180,301 B2 11/2021 Smalley
D944,656 S 3/2022 Spivey, Sr.
D946,416 S 3/2022 Smalley
D946,417 S 3/2022 Gonzalez Manzano
D946,418 S 3/2022 Gonzalez Manzano
D946,419 S 3/2022 Gonzalez Manzano
D946,420 S 3/2022 Gonzalez Manzano
D946,421 S 3/2022 Gonzalez Manzano
11,261,013 B2 3/2022 Smalley
11,261,014 B2 3/2022 Zacherle
11,286,094 B2 3/2022 Gonzalez Manzano
D955,889 S 6/2022 Gonzalez Manzano
D955,890 S 6/2022 Gonzalez Manzano
11,365,039 B2 6/2022 Berga Ferres
D956,574 S 7/2022 Gonzalez Manzano
11,401,094 B2 8/2022 McCree
11,401,095 B2 8/2022 Rosenbrien
11,420,802 B2 8/2022 Kooc
D962,789 S 9/2022 Noel
11,447,317 B2 9/2022 Zacherle et al.
D974,923 S * 1/2023 Smalley ..... D9/752
D984,279 S 4/2023 McCree
11,628,994 B2 4/2023 McCree
D1,000,290 S 10/2023 Thompson
2002/0195371 A1 12/2002 Brown
2003/0080004 A1 5/2003 Olsen et al.
2003/0213705 A1 11/2003 Woog
2004/0007480 A1 1/2004 Pattee et al.
2004/0134799 A1 7/2004 Mattson
2004/0206639 A1 10/2004 Karlsson
2004/0211695 A1 10/2004 Karlsson
2004/0226833 A1 11/2004 Daniel
2005/0127151 A1 6/2005 Johnson
2005/0199513 A1 9/2005 Bakx et al.
2006/0255114 A1 11/2006 Hand et al.
2007/0080084 A1 4/2007 Sutherland
2007/0163908 A1 7/2007 Sutherland
2007/0193889 A1 8/2007 Olsen et al.
2008/0257763 A1 10/2008 Ogg
2009/0101526 A1 4/2009 Sutherland et al.
2009/0127147 A1 5/2009 Sutherland
2010/0078337 A1 4/2010 Sutherland et al.
2010/0264043 A1 10/2010 DePaula
2011/0000799 A1 1/2011 Gonzalez
2012/0080328 A1 4/2012 DePaula
2012/0138489 A1 6/2012 Holley, Jr.
2015/0191287 A1 7/2015 L'Heureux et al.
2016/0159546 A1 6/2016 Cassidy
2016/0280436 A1 9/2016 Taylor et al.
2016/0325899 A1 11/2016 L'Heureux et al.
2018/0111734 A1 4/2018 Jego
2018/0222650 A1 8/2018 Zacherle
2018/0362234 A1 12/2018 L'Heureux et al.
2019/0119019 A1 4/2019 Patton
2019/0135512 A1 5/2019 Kooc
2019/0233145 A1 8/2019 Kooc
2020/0010255 A1 1/2020 Zacherle et al.
2020/0079564 A1 3/2020 Ford
2020/0189817 A1 6/2020 Smalley
2020/0189818 A1 6/2020 McCree
2020/0189819 A1 6/2020 McCree
2020/0189821 A1 6/2020 Smalley
2020/0189822 A1 6/2020 Smalley
2020/0223612 A1 7/2020 Swenson
2021/0061502 A1 3/2021 Johnston
2021/0094742 A1 4/2021 Gonzalez Manzano
2021/0276776 A1 9/2021 Zammit
2021/0316921 A1 10/2021 Holtz
2021/0331847 A1 10/2021 Gonzalez Manzano
2021/0331848 A1 10/2021 Gonzalez Manzano
2021/0339928 A1 11/2021 Blin

(56) References Cited

U.S. PATENT DOCUMENTS

| | | | | |
|---|---|---|---|---|
| 2022/0009685 | A1 | 1/2022 | Thompson | |
| 2022/0097941 | A1 | 3/2022 | McCree | |
| 2022/0396407 | A1 | 12/2022 | Thompson | |
| 2022/0411155 | A1 | 12/2022 | Ford | |
| 2022/0411156 | A1 | 12/2022 | Ford | |
| 2023/0019145 | A1* | 1/2023 | Thompson | B65D 71/44 |
| 2023/0031526 | A1 | 2/2023 | Holley, Jr. | |
| 2023/0286717 | A1 | 9/2023 | Garnier | |
| 2023/0303300 | A1 | 9/2023 | Spivey, Sr. | |
| 2023/0322458 | A1 | 10/2023 | Barrette | |
| 2023/0382619 | A1 | 11/2023 | Ford | |
| 2024/0034532 | A1 | 2/2024 | Merzeau | |

FOREIGN PATENT DOCUMENTS

| | | | |
|---|---|---|---|
| CA | 2133827 | | 10/1993 |
| DE | 298 13 672 | U1 | 11/1998 |
| DE | 203 19 247 | U1 | 5/2004 |
| DE | 10 2009 059 047 | A1 | 6/2011 |
| DE | 20 2018 106 535 | | 1/2019 |
| EM | 008574800-0008 | | 12/2021 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 1 340 691 | A1 | 9/2003 |
| EP | 1 401 727 | B1 | 6/2006 |
| EP | 1 910 187 | B1 | 3/2009 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| ES | 2159235 | | 9/2001 |
| FR | 2 737 196 | A1 | 1/1997 |
| GB | 1 256 684 | | 12/1971 |
| GB | 2 221 666 | A | 2/1990 |
| GB | 2 321 229 | A | 7/1998 |
| GB | 9006736716 | | 8/2019 |
| GB | 2591535 | A | 8/2021 |
| GB | 6161591 | | 9/2021 |
| JP | 37-15730 | | 9/1960 |
| JP | 10-194330 | A | 7/1998 |
| JP | 10-297668 | A | 11/1998 |
| JP | 11-193059 | | 7/1999 |
| JP | 11-193059 | A | 7/1999 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 91/05716 | A1 | 5/1991 |
| WO | WO 93/02941 | | 2/1993 |
| WO | WO 93/02941 | A1 | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 95/10459 | A1 | 4/1995 |
| WO | WO 95/22495 | A1 | 8/1995 |
| WO | WO D036442-002 | | 7/1996 |
| WO | WO 96/26128 | A1 | 8/1996 |
| WO | WO 96/32340 | A1 | 10/1996 |
| WO | WO 2006/044583 | A2 | 4/2006 |
| WO | WO 2008/058294 | A1 | 5/2008 |
| WO | WO 2009/023822 | A1 | 2/2009 |
| WO | WO 2010/006629 | A1 | 1/2010 |
| WO | WO 2010/101852 | A1 | 9/2010 |
| WO | WO 2016/008744 | A1 | 1/2016 |
| WO | WO 2016/100010 | A1 | 6/2016 |
| WO | WO 2016/112145 | A1 | 7/2016 |
| WO | WO 2020/210562 | A1 | 10/2020 |
| WO | WO 2021/038516 | A1 | 3/2021 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).

Enviroclip. Date posted: 2022. Site visited: Sep. 12, 2022. Available online: https://www.graphicpkg.com/products/enviroclip/ (Year: 2022).

"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).

"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).

Cap-it packaging video on Vimeo. Date posted: 2021. Site visited: Sep. 19, 2022. Available online: https://vimeo.com/610619455?embedded=true&source=vimeo_logo&owner=24551687 (Year: 2021).

2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

International Search Report and Written Opinion for PCT/US2022/032608 dated Sep. 28, 2022.

International Search Report and Written Opinion for PCT/US2022/034840 dated Oct. 21, 2022.

International Search Report and Written Opinion for PCT/US2022/036297 dated Oct. 21, 2022.

International Search Report and Written Opinion for PCT/US2022/037069 dated Oct. 28, 2022.

International Search Report and Written Opinion for PCT/US2022/037071 dated Nov. 2, 2022.

International Search Report and Written Opinion for PCT/US2022/038638 dated Nov. 8, 2022.

International Search Report and Written Opinion for PCT/US2022/035207 dated Oct. 14, 2022.

6 Pack Cardboard Carrier_Beer Carriers_Pak-It Products, [date first available: Dec. 9, 2021], [date found online: Jun. 10, 2024], https:/www.pakitproducts.com/product/recyclable-6-pak-cardboard-can-carrier/ (Year: 2021).

Introducing Fishbone Recyclable Can Carrier System_Atlantic Packaging, [date first available: December 7, 20202], [date found online: Jun. 11, 2024], https://www.atlanticpkg.com/2020/12/introducing-fishbone-recyclable-can-carrier-system/ (Year: 2020).

WestRock Company_YouTube, [date first posted: Jul. 22, 2020], [date found online: Jun. 12, 2024], https://www.youtube.com/watch?v=LAq-uYiU2UE (Year: 2020).

Asahi Breweries First Japanese User of WestRock Cancollar® Eco Packaging, [date first posted: Oct. 15, 2021], [date found online: Jun. 12, 2024], https://www.asahibeer.com.jp/news/2021/1015_2.html (Year 2021).

Smurtfit Kappa GreenClip_Facebook, [date first posted: Dec. 7, 2020], [date found online: Jun. 12, 2024], https://www.facebook.com/SmurfitKappaGroup/videos/smurfit-kappa-greenclip/410973346931978/ (Year: 2020).

Smurfit Kappa and KHS Join Forces for TopClip Solution_ThePackagingPortal.com, [date first available: Nov. 19, 2020], [date found online: Jun. 24, 2024], https://www.thepackagingportal.com/industry-news/smurfit-kappa-and-khs-join-forces-for-topclip-solution (Year: 2021).

* cited by examiner

103

CARRIER FOR CONTAINERS

CROSS-REFERENCE TO RELATED APPLICATION

This application claims the benefit of U.S. Provisional Patent Application No. 63/216,062, filed on Jun. 29, 2021.

INCORPORATION BY REFERENCE

The disclosure of U.S. Provisional Patent Application No. 63/216,062, filed on Jun. 29, 2021, is hereby incorporated by reference for all purposes as if presented herein in its entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a plurality of panels comprising at least one attachment panel configured to receive a portion of one or more containers of the plurality of containers, at least one side panel, and at least one top panel, and locking features for maintaining an erected configuration of the carrier, the locking features comprising at least one male locking feature extending from a respective panel of the plurality of panels being at least partially received in a respective at least one female locking feature at least partially defined in a respective panel of the plurality of panels.

According to another aspect, the disclosure is generally directed to a blank for forming a carrier for holding a plurality of containers, the blank comprising a plurality of panels comprising at least one attachment panel configured to receive a portion of one or more containers of the plurality of containers, at least one side panel, and at least one top panel, and locking features for maintaining an erected configuration of the carrier formed from the blank, the locking features comprising at least one male locking feature extending from a respective panel of the plurality of panels for being at least partially received in a respective at least one female locking feature at least partially defined in a respective panel of the plurality of panels when the carrier is formed from the blank.

According to another aspect, the disclosure is generally directed to a method for forming a carrier for holding a plurality of containers, the method comprising obtaining a blank comprising plurality of panels including at least one attachment panel configured to receive a portion of one or more containers of the plurality of containers, at least one side panel, and at least one top panel, and locking features comprising at least one male locking feature extending from a respective panel of the plurality of panels and at least one female locking feature at least partially defined in a respective panel of the plurality of panels, positioning the at least one attachment panel for at least partially receiving one or more containers of the plurality of containers, and at least partially inserting the at least one male locking feature through the at least one female locking feature to maintain an erected configuration of the carrier.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
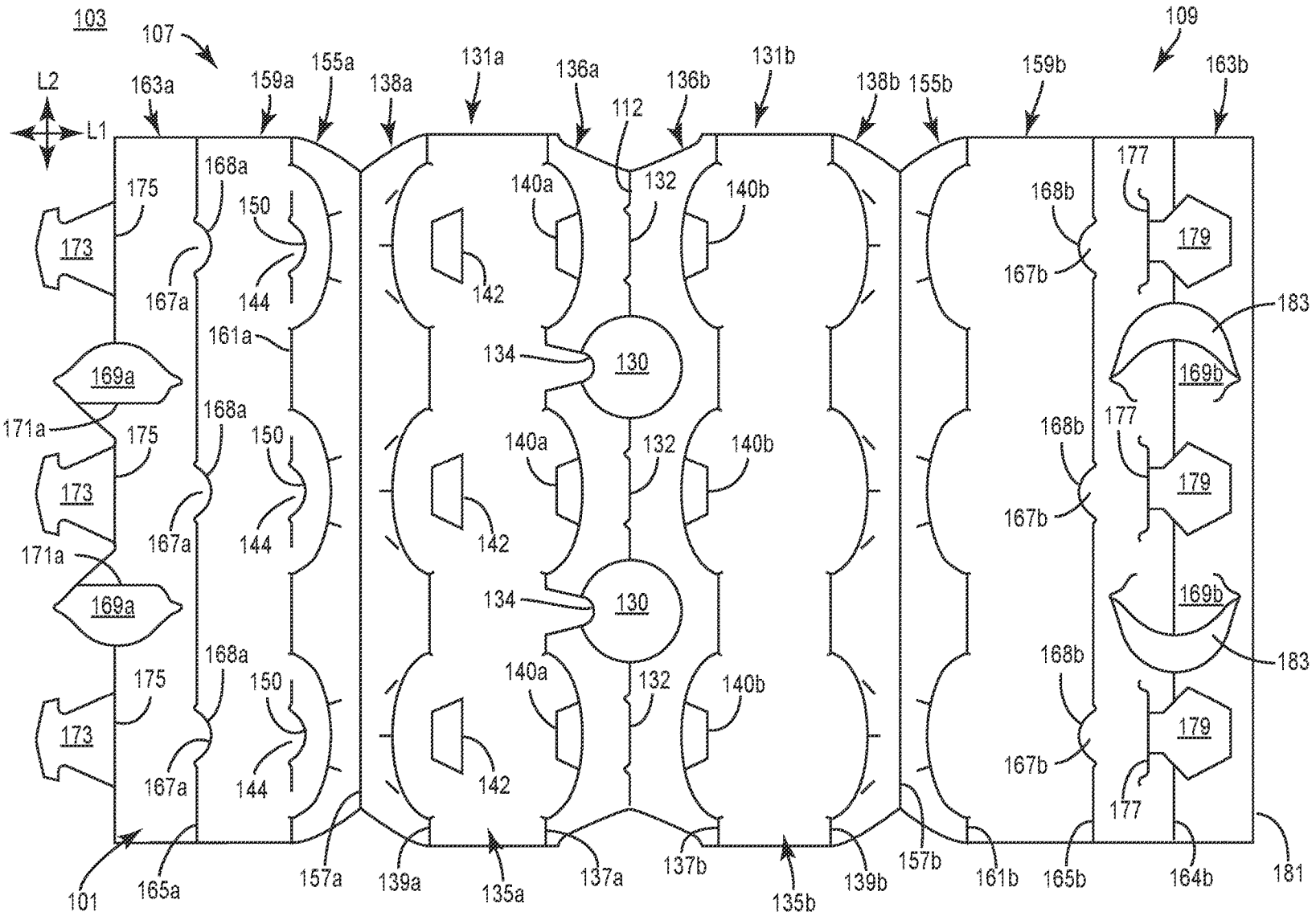
FIG. 1 is a plan view of an outer surface of a blank for forming a carrier and package according to a first exemplary embodiment of the disclosure.
Figure 2:
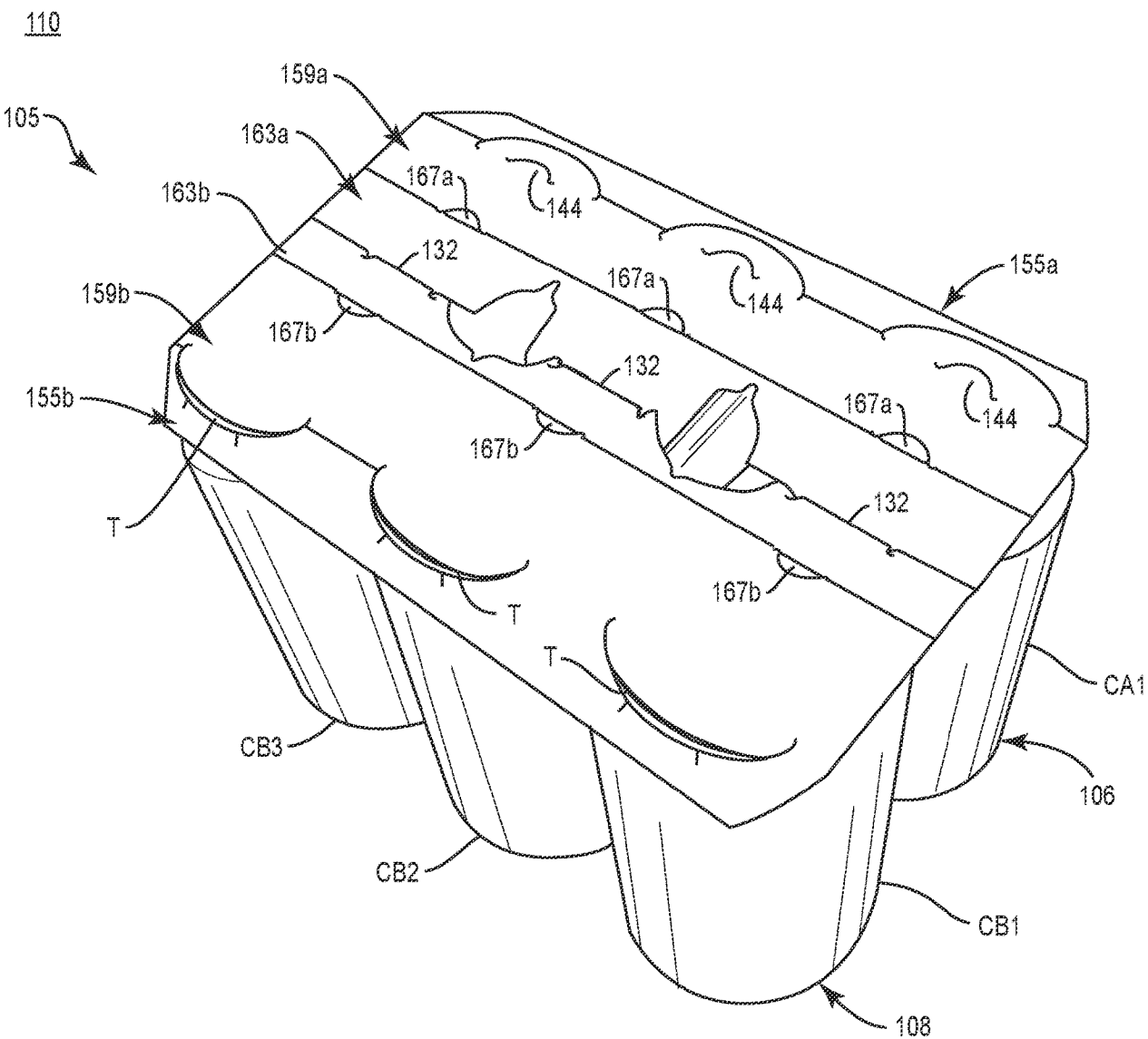
FIG. 2 is a perspective view of the carrier and package formed from the blank of FIG. 1 according to the first exemplary embodiment.

FIG. 1 shows a plan view of an exterior side 101 of a blank 103 used to form a carrier 105 (FIG. 2) in accordance with a first exemplary embodiment of the disclosure. As shown in FIG. 2, the carrier 105 is sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. In some embodiments, the containers can have an upper rim or other top portion having an outer diameter of 53 mm, 58 mm, or 56 mm.

The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure. The carrier 105 can be provided together with one or more containers as a package 110 (FIG. 2).

As shown in FIG. 1, the blank 103 has a longitudinal axis L1 and a lateral axis L2. The blank 103 has a front portion 107 for forming the front portion 106 of the carrier 105 and a back portion 109 for forming the back portion 108 of the carrier 105. The front portion 107 and the back portion 109 of the blank 103 are foldably connected at a lateral fold line 112 that forms a lateral centerline CL of the blank 103, as shown, and which can be interrupted by a plurality of laterally spaced cuts or locking openings 132 (broadly, "female locking features" or "second female locking features"). As described herein, locking openings can designate openings formed in one or more portions of a blank/carrier upon separation of one or more portions thereof and/or cuts or other lines of weakening that facilitate such separation.

With continued reference to FIG. 1, the front portion 107 of the blank 103 can include a front container retention panel or front attachment panel 131*a*, and a pair of laterally spaced handle openings 130 can interrupt the fold line 112 and at least partially extend into the attachment panel 131*a*. As also shown, the handle openings 130 can extend into portions of the back portion 109 of the blank 103.

Figure 1A:
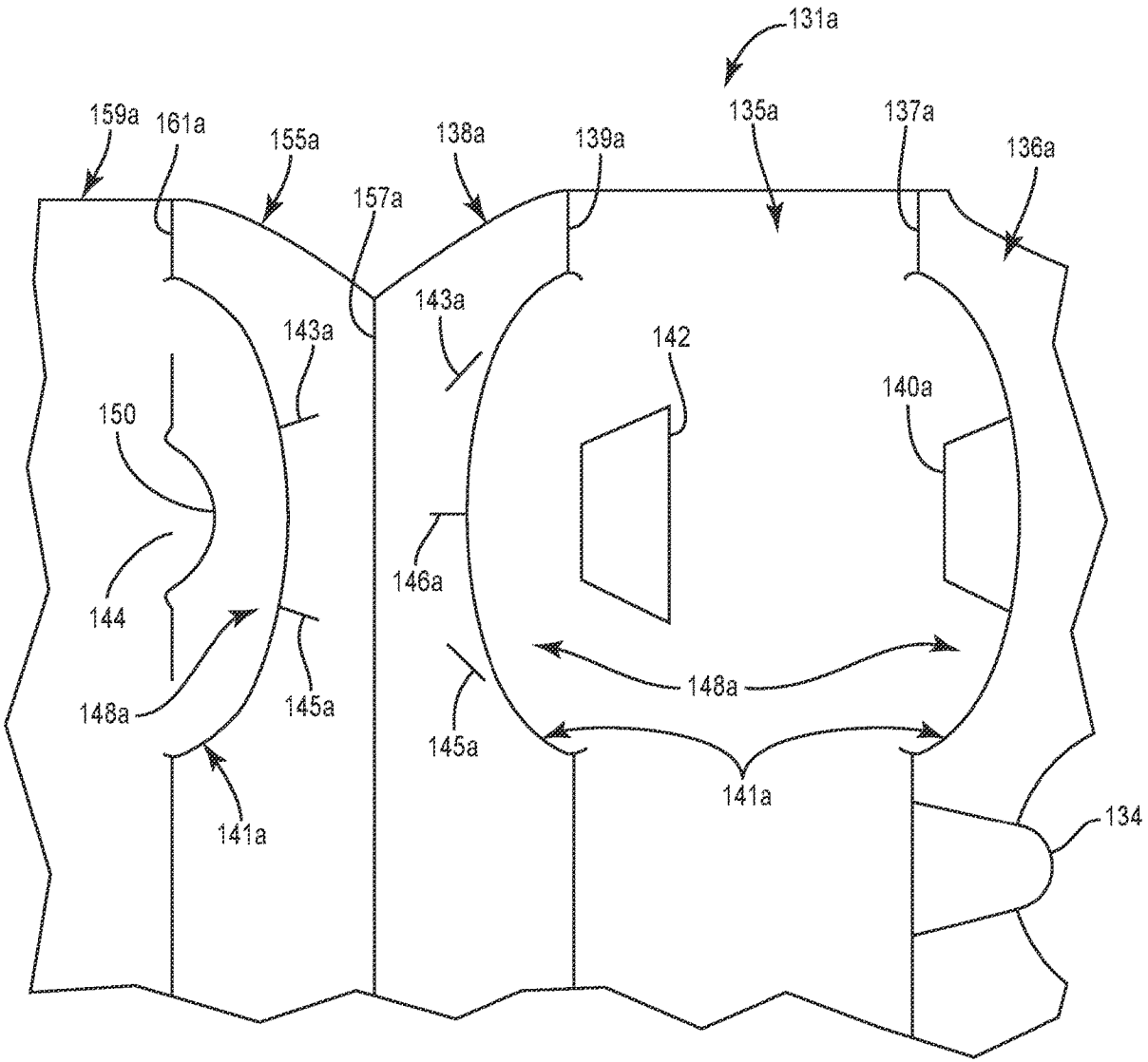
FIG. 1A is an enlarged view of a portion of the blank of FIG. 1.

With additional reference to the enlarged view of FIG. 1A, the front attachment panel 131*a* can also include a container retention portion 135*a* that is at least partially defined between a pair of longitudinally-spaced lateral fold lines 137*a*, 139*a* that are each interrupted by a respective pair of longitudinally-spaced cuts 141*a* that can each include one or more curved and/or angled portions. As shown, the longitudinally-spaced cuts 141*a* define container retention tabs 148*a* that extend outwardly from the container retention portion 135*a*. As also shown, respective oblique cuts 143*a*, 145*a* can extend outwardly from one or more cuts 141*a* that interrupt the fold line 139*a*. Furthermore, longitudinal cuts 146*a* can extend outwardly from respective central portions of the cuts 141*a*.

As shown, an interior marginal portion 136*a* of the attachment panel 131*a* is at least partially defined between the fold lines 137*a*, 112 and an exterior marginal portion 138*a* of the attachment panel 131*a* is at least partially defined between the fold line 139*a* and a lateral fold line 157*a* adjacent the attachment panel 131*a*.

The blank 103 can also include locking features for forming locking features of the carrier 105. Such locking features can include a plurality of male locking features and a plurality of male locking features, the female locking features configured to at least partially receive a portion of the respective male locking features. As shown, the locking features can include a pair of locking tabs 134 (broadly, "male locking features" or "fourth male locking features") extending from the attachment panel 131*a* and interrupting the fold line 137*a* and extending into the respective handle apertures 130. Locking features of the blank 103/carrier 105 positioned in the attachment panel 131*a* can also include a plurality of locking openings 140*a* (broadly, "female locking features" or "first female locking features") at least partially defined in the container retention portion 135*a* of the attachment panel 135*a* and intersecting the respective cuts 141*a* along the fold line 137*a* and a plurality of locking openings 142 (broadly, "female locking features" or "first female locking features" or "fourth female locking features") laterally spaced away from the locking openings 140*a* and at least partially defined in the container retention portion 135 of the attachment panel 131*a*.

A bevel or front side panel 155*a*, as shown, can be foldably connected to the front attachment panel 131*a* at the lateral fold line 157*a*, and a front top panel 159*a* can be foldably connected to the front side panel 155*a* at a lateral fold line 161*a*. The lateral fold line 161*a* can be interrupted by a plurality of the cuts 141*a* so as to define container retention tabs 148*a* protruding from the top panel 159, as described further herein. Positioned along each container retention tab 148*a* is a respective locking tab 144 (broadly, "male locking features" or "first male locking features" or "third male locking features") formed by a respective line of weakening 150 having one or more of curved, angled, and/or straight portions such that the locking tabs 144 extend from the top panel 159*a*. While the fold line 161*a* is illustrated as extending partially along the lateral length of the blank 103, it will be understood that the fold line 161*a* can extend the full lateral length of the blank 103 without departing from the disclosure.

A front locking panel 163*a* can be foldably connected to the top panel 159*a* at a lateral fold line 165*a* interrupted by a plurality of laterally spaced locking tabs 167*a* (broadly, "male locking features" or "first male locking features") formed by respective curved cuts 168*a* so as to be arranged for extending from the locking panel 163*a*. The locking panel 163*a* can include handle features including handle reinforcement flaps or tabs 169*a* foldably connected to the front locking panel 163*a* at respective longitudinal fold lines 171*a* and for being aligned/cooperating with the respective handle openings 130, as described further herein.

Still referring to FIG. 1, locking tabs 173 (broadly, "male locking features" or "second male locking features") can be foldably connected to the front locking panel 163*a* at respective lateral fold lines 175 and/or can otherwise extend from the front locking panel 163*a*. As shown, the locking tabs 173 can have a base portion that expands to a distal portion or locking head/feature to present multiple locking edges.

In the illustrated embodiment, the back portion 109 of the blank 103 includes a back container retention panel or back attachment panel 131*b*, a back bevel panel or back side panel 155*b*, a back top panel 159*b*, and a back locking panel 163*b* having associated features that are generally a mirror-image of the corresponding portions of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103. An enlarged view of a portion of the back portion 109 of the blank 103 is illustrated in FIG. 1B.

Figure 1B:
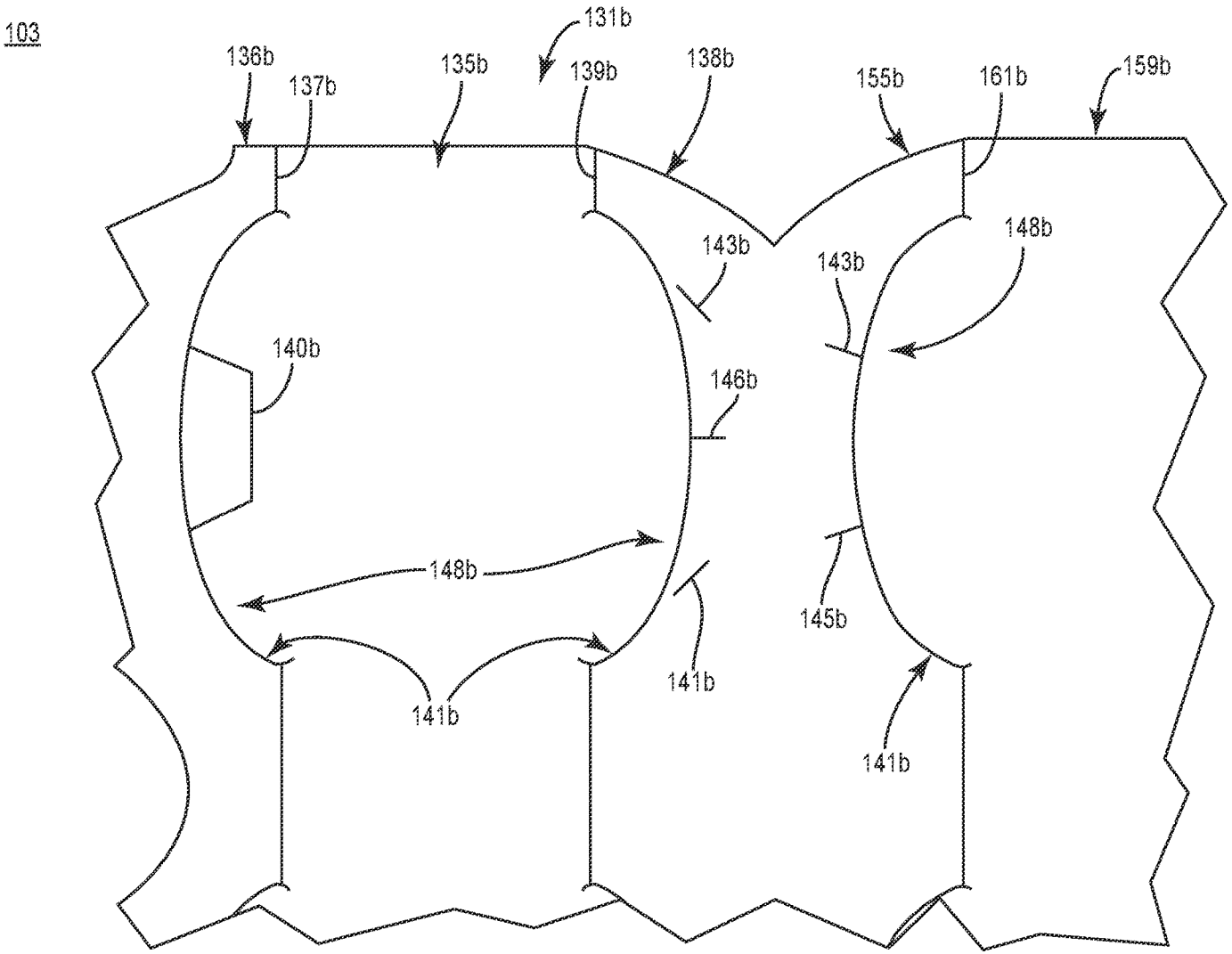
FIG. 1B is an enlarged view of another portion of the blank of FIG. 1.

With continued reference to FIGS. 1A, and 1B, the back attachment panel 131*b*, as shown, can be devoid of the locking tabs 134 and the locking openings 142. In addition, the back top panel 155*b* can be devoid of the locking tabs 144.

With regard to the back locking panel 163*b*, the back locking panel 163*b* can be at least partially bisected by a lateral fold line or other line of weakening 164*b* so as to form a proximal portion and distal portion thereof, or to form a first back top panel and a second back top panel. As shown, a plurality of laterally spaced locking openings 177 (broadly, "female locking features" or "third female locking features" or "fifth female locking features") can be at least partially defined in the back locking panel 163*b*, and a plurality of generally polygonal, e.g., pentagonal, locking openings 179 (broadly, "female locking features" or "third female locking features" or "fourth female locking features" or "fifth female locking features") can extend from the respective locking openings 177 toward a lateral free edge 181 (broadly, "locking edge" or "locking tab") of the back locking panel 163*b*.

As shown in FIG. 1, handle features of the back locking panel 163*b* can additionally include a pair of laterally spaced handle openings 183 adjacent the respective handle reinforcement flaps 169*b* which extend into the handle openings 183. While the handle openings 183 are illustrated as generally crescent-shaped or otherwise curved, the handle openings 183 can have a different arrangement without departing from the disclosure.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 3:
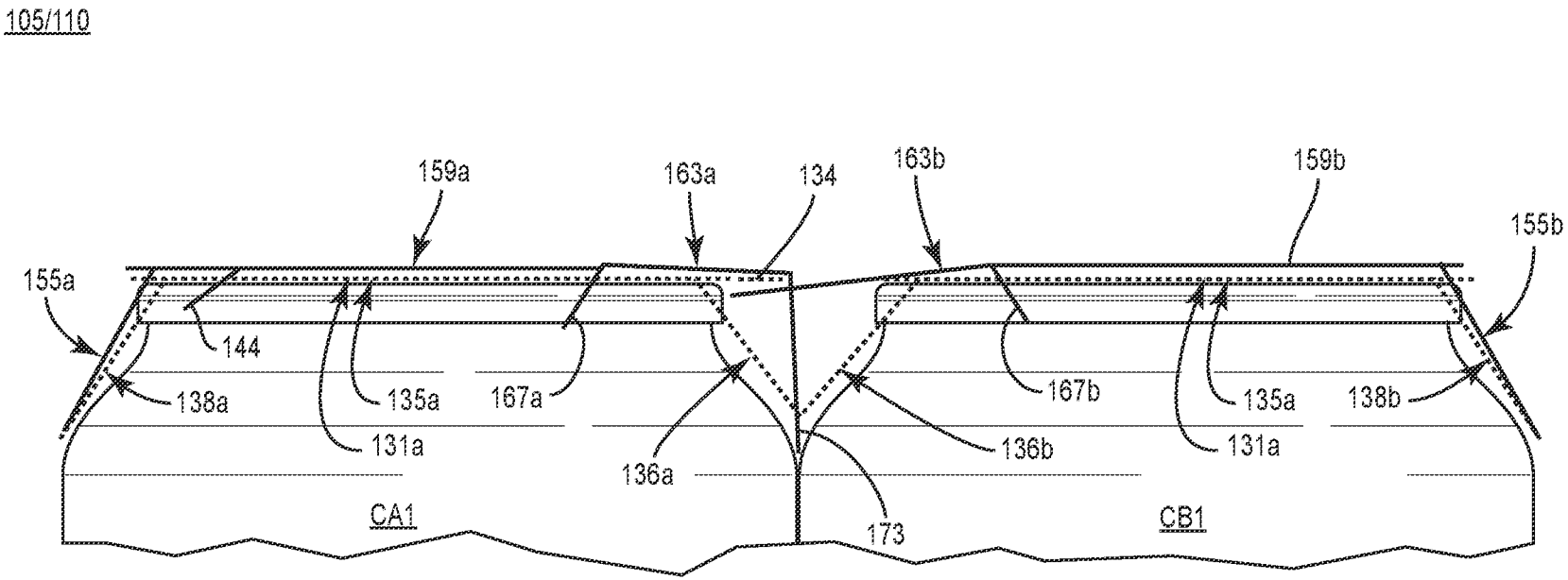
FIG. 3 is a schematic view of a portion of a side of the carrier and package formed from the blank of FIG. 1 according to the first exemplary embodiment.

With additional reference to FIGS. 2-3, according to one exemplary embodiment of forming the carrier 105, the blank 103 can be inverted such that the exterior surface 101 of the blank 103 can be placed atop the containers CA1, CA2, CA3, CB1, CB2, CB3 such that the container retention portion 135*a* of the front attachment panel 131*a* overlies the containers CA1, CA2, CA3 and such that the container retention portion 135*b* of the back attachment panel 131*b* overlies the containers CB1, CB2, CB3. Further downward movement of the attachment panels 131*a*, 131*b* over the plurality of containers CA1, CA2, CA3, CB1, CB2, CB3 can activate the respective container retention portions 135*a*, 135*b* to engage respective containers.

For example, as the front attachment panel 131*a* is lowered or urged downwardly onto the containers CA1, CA2, CA3, the container retention portion 135*a* can at least partially separate from the remainder of the front attachment panel 131*a* at the cuts 141*a*. In such an arrangement, upper or top portions T of the respective containers CA1, CA2, CA3 can extend at least partially through respective openings formed by the respective cuts 141*a* such that the container retention tabs 148*a* can sit within recessed portions of the containers CA1, CA2, CA3, e.g., recessed tops of the containers CA1, CA2, CA3 below rolled upper rims thereof.

The marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*. Such movement can cause reconfiguration of the outer marginal portion 138*a* of the top attachment panel 131*a* to reconfigure at the respective cuts 143*a*, 145*a*, 146*a* to engage a rolled/flanged rim or other top structure of the respective containers CA1, CA2, CA3.

The back attachment panel 131*b* and corresponding container retention portion 135*b* can engage the containers CB1, CB2, CB3 in a similar manner as described above with respect to the engagement of the front attachment panel 131*a* and container retention portion 135*a* with respect to the containers CA1, CA2, CA3. The reconfiguration of the corresponding portions of the back attachment panel 131*b* can occur as the back attachment panel 131*b* is lowed or urged downwardly onto the containers CB1, CB2, CB3 as described above with regard to the front attachment panel 131*a*.

Still referring to FIGS. 2 and 3, the front side panel 155*a* can be folded upwardly at the fold line 157*a*, for example, to be at an oblique arrangement relative to the attachment portion 135*a* of the attachment panel 131*a*, and the top panel 159*a* can be folded at the fold line 161*a* into at least partial face-to-face contact with at least a portion of the attachment panels 131*a*, 131*b*. Such movement of the top panel 159*a* can cause the container retention tabs 148*a* to separate from the front side panel 155*a* at the respective cuts 141*a*, and can at least partially overlie the container retention tabs 148*a* associated with the attachment panel 131*a*. In this regard, the rolled rim or other top structure of the respective containers CA1, CA2, CA3 can be at least partially received through the cuts 141*a* along the fold line 161*a* such that the container retention tabs 148*a* extending from the top panel 159 can also sit within recessed upper portions of the containers CA1, CA2, CA3.

Similarly, the back side panel 155*b* can be folded upwardly at the fold line 157*b* into an oblique arrangement relative to the attachment portion 135*b* of the back attachment panel 131*b*, and the back top panel 159*b* can be folded at the fold line 161*b* into at least partial face-to-face contact with the top panel 159*b* and/or the attachment panel 131*b*. Such movement of the back top panel 155*b* can cause engagement with the containers CB1, CB2, CB3 in a manner similar to that described above with regard to the engagement of the front top panel 159*a* with the containers CA1, CA2, CA3.

The back locking panel 163*b* can be folded at the fold line 165*b* to at least partially overlie respective portions of the attachment panel 131*b*. In such an arrangement, the locking tabs 167*b* (broadly, "male locking features" or "fifth male locking features") can be at least partially separated from the fold line 165*b* and at least partially inserted through/received in the locking openings 140*b* (broadly, "female locking features" or "first female locking features" or "sixth female locking features") at least partially defined in the back attachment panel 131*b* to position the locking tabs 167*b* at least partially tucked under the back attachment panel 131*b*. Furthermore, the locking edge 181 of the back locking panel 163*b* can be tucked under or otherwise underlapped under the locking tabs 134 extending from the front attachment panel 131*a*. In this regard, the locking tabs 134 can be positioned in at least partial face-to-face contact with respective portions of the back locking panel 163*b*.

In the aforementioned arrangement, the locking openings 177 can be positioned over/aligned with the locking openings 132 along the fold line 112 and the locking openings 179 can be positioned over/aligned with the locking openings 140*a* in the front attachment panel 131*a*.

Thereafter, the back locking panel 163*a* can be folded at the fold line 165*a* to at least partially overlie respective portions of the attachment panel 131*a*. In such an arrangement, the locking tabs 144 can be at least partially separated from the container retention tabs 148*a* in the front top panel 159*a* at the lines of weakening 150 and at least partially inserted through or tucked under the edges of the locking openings 142 in the front attachment panel 131*a*.

Furthermore, the locking tabs 167*a* can at least partially separated from the front top panel 159*a* at the cuts 160*a* and can be at least partially inserted through and received in the aligned locking openings 179, 140*a*. Such movement of the panels of the blank 103/carrier 105 can also position the locking tabs 173 over the aligned locking openings 177, 132 such that the locking tabs 173 can be manipulated to be inserted at least partially through and received in the locking openings 177, 132. For example, the locking tabs 173 can be at least partially folded downwardly at the respective fold lines 175, inserted through the locking openings 177, and at least partially inserted through the locking openings 132 aligned therebelow.

Such interlocking engagement of the locking features of the carrier 105 and the carriers and packages disclosed herein can provide a robust construction of the carrier that is resistant to incidental loosening/movement/shifting and can contribute to maintain an erected configuration of the carrier 105 and a tight and secure engagement with the containers CA1, CA2, CA3, CB1, CB2, CB3. For example, the aforementioned arrangement of locking features presents multiple plies and interfering edges of material, e.g., paperboard, that forms the carrier 105 such that the various locking features provide a compounding effect that reinforces the strength/integrity of the carrier 105. In some embodiments, the engagements of the various male locking features and respective female locking features described herein can provide a desired level of tension or tightness of the carrier around the containers. A schematic illustration of the interaction of the locking features of the carrier 105 is provided in FIG. 3. In this regard, the blank 103/carrier 105 can be formed and maintained in an erected configuration with a minimized application of adhesive such as glue, or, in embodiments, so as to be devoid of an adhesive such as glue.

The above-described arrangement of the panels of the carrier can thus align the various handle features, e.g., the handle reinforcement flaps 169*a*, 169*b* (and adjacent handle opening 183) and the handle openings 130 such that a user can at least partially insert one or more of his or her fingers downwardly against the reinforcement flap 169*a*, 169*b* to cause at least partial separation thereof from the respective locking panels 163*a*, 163*b* and downward folding at the respective fold lines 171*a*, 171*b* to allow the user to grasp the carrier 105 along portions of the attachment panels 131*a*, 131*b* exposed under the handle openings 130. The reinforcement flaps 169*a*, 169*b* can provide additional plies of material, e.g., as a buffer, between the user's fingers and the carrier, for example, to resist deformation/tearing of one or more portions of the carrier 105, for the user's comfort, to avoid, pinching of the user's fingers, etc.

The package 110/carrier 105 described above has a compact structure that can, for example, provide materials savings and waste reduction. Further, the exposure of one or more portions of the containers CA1, CA2, CA3, CB1, CB2, CB3 on exterior portions of the carrier 105/package 110 provides a consumer with a clear view of labeling or surface graphics associated with the containers CA1, CA2, CA3, CB1, CB2, CB3 as well as providing convenient access to remove one or more of the containers CA1, CA2, CA3, CB1, CB2, CB3 from the carrier 105/package 110, for example, by withdrawing a respective container through the respective cuts 141*a*, 141*b* to disengage the container from the respective panels 131*a*, 131*b*, 159*a*, 159*b*.

Figure 4:
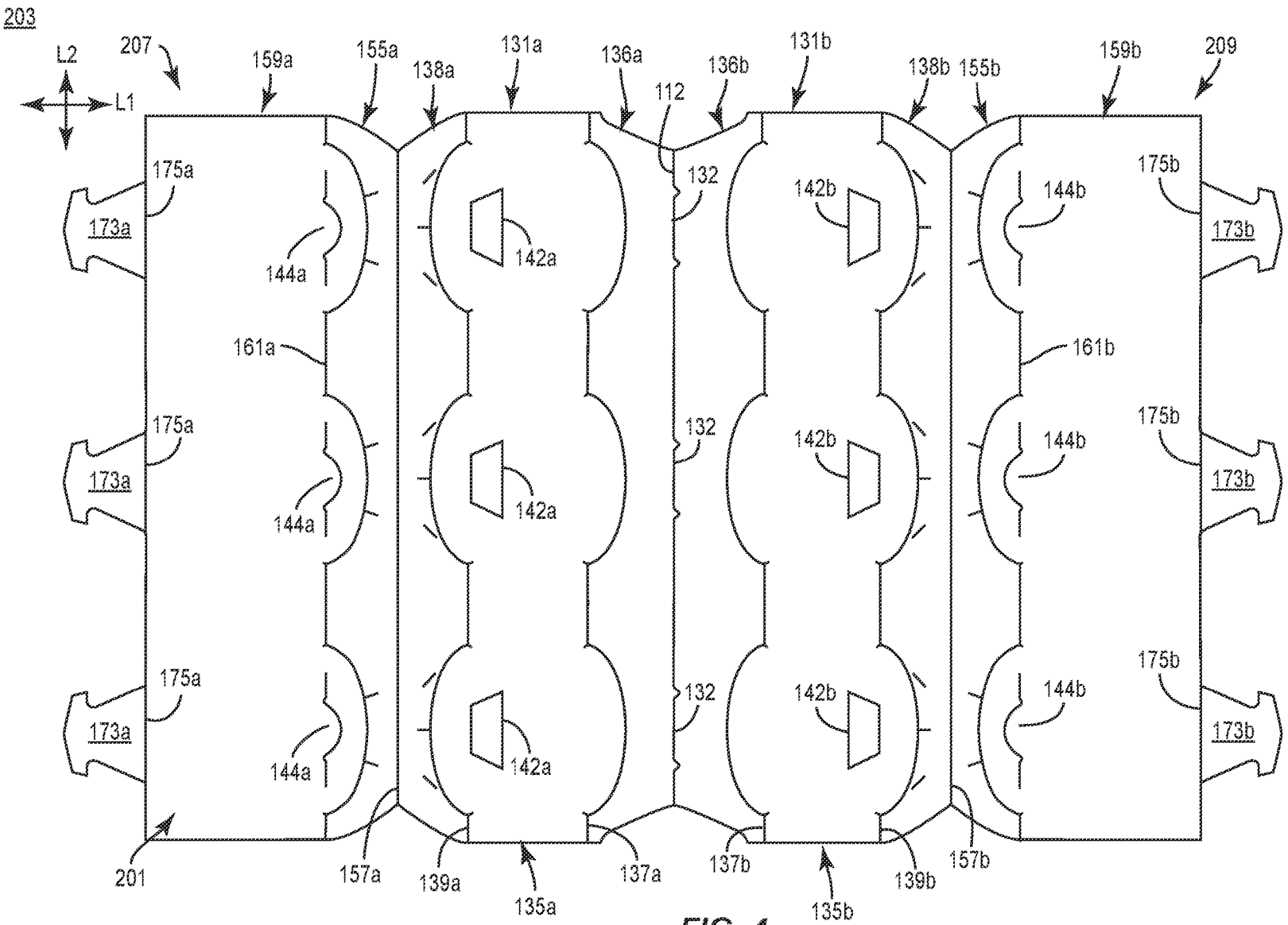
FIG. 4 is a plan view of an outer surface of a blank for forming a carrier and package according to a second exemplary embodiment of the disclosure.

FIG. 4 is a plan view of the exterior surface 201 of a blank 203 for forming a carrier 205 (FIG. 4A) and package 210 (FIG. 4A) according to a second exemplary embodiment of the disclosure. The blank 203 and carrier 205/package 210 formed therefrom can have one or more features that are the same or similar to those described above with respect to the blank 103 and carrier 105/package 110 described above, and like or similar features are designated with like or similar reference numerals. Accordingly, the blank 203 can include a front portion 207 for forming a front portion 206 of the carrier 205/package 210 and a back portion 209 for forming a back portion 208 of the carrier 205/package 210.

The blank 203 can have the longitudinal axis L1 and the lateral axis L2, the attachment panels 131*a*, 131*b*, the side panels 155*a*, 155*b*, the top panels 159*a*, 159*b*, and associated features.

In addition, the locking openings 142 positioned in the attachment panel 131*a* of the blank 203 can be front locking openings 142*a*, and back locking openings 142*b* (broadly, "female locking features" or "first female locking features" or "third female locking features") can be at least partially defined in the attachment panel 131*b* of the blank 203. Further, the locking tabs 144 in the container retention tabs extending from the top panel 159*a* can be front locking tabs 144*a*, and the blank 203 can additionally include back locking tabs 144*b* (broadly, "male locking features" or "third male locking features") in the container retention tabs 148*b* extending from the back top panel 159*b*.

With continued reference to FIG. 4, locking tabs that are similar to the locking tabs 173 described above can be front locking tabs 173*a* attached to the top panel 159*a* at respective lateral fold lines 175*a*, and the blank 203 can also include back locking tabs 173*b* (broadly, "male locking features" or "fourth male locking features") foldably connected to and extending from the top panel 159*b* at respective lateral fold lines 175*b*.

In this regard, the blank 203 and carrier 205/package 210 formed therefrom can have a different number and arrangement of panels, handle features, and locking features as compared to the blank 103 and carrier 105/package 110 described above. It will be understood that the blank 203/carrier 205/package 210 can have a further different arrangement and/or configuration without departing from the disclosure.

Figure 4A:
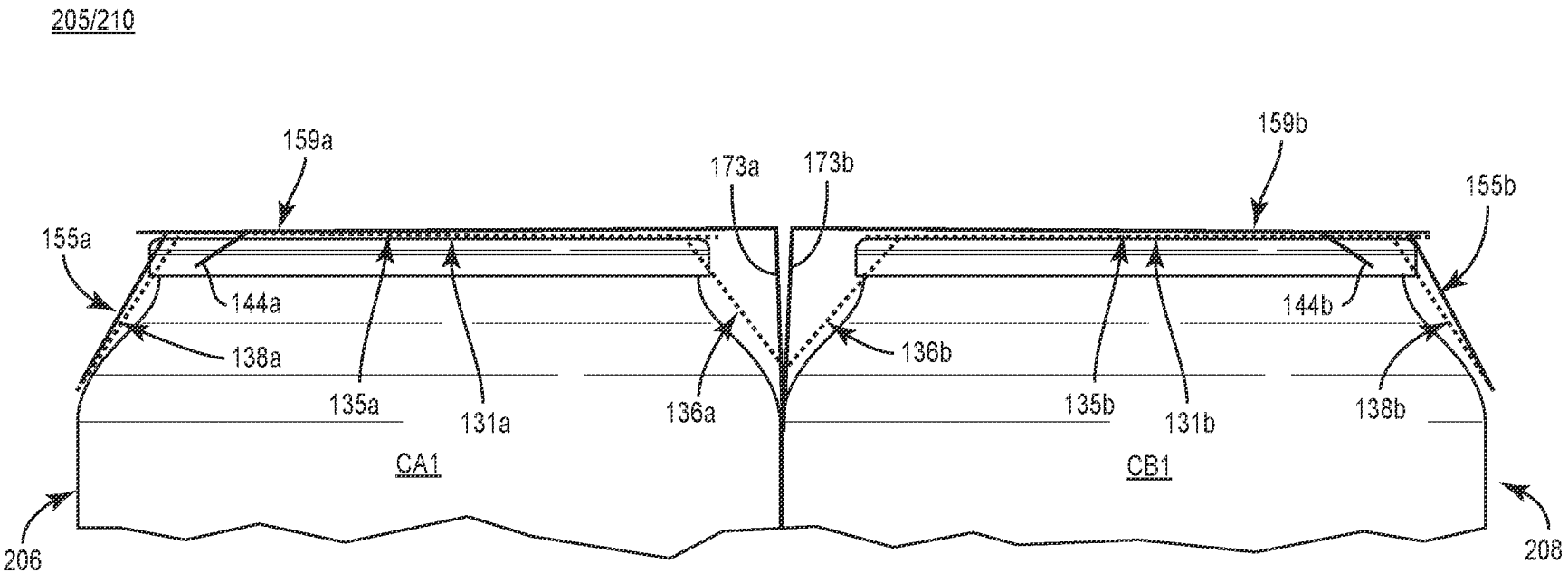
FIG. 4A is a schematic view of a portion of a side of the carrier and package formed from the blank of FIG. 4 according to the second exemplary embodiment of the disclosure.

With additional reference to FIG. 4A, the blank 203 can be formed into the carrier 205/package 210 in a manner similar to that described above with regard to the formation of the carrier 105/package 110 from the blank 103, without the action of the locking panels 163*a*, 163*b* as described above. For example, the containers CA1, CA2, CA3, CB1, CB2, CB3 can be at least partially received through openings formed in the respective attachment panels 131*a*, 131*b* via relative folding of one or more portions thereof as described above. The side panels 155*a*, 155*b* can further be positioned in generally oblique relation to respective portions of the attachment panels 131*a*, 131*b* as described above, and the top panels 159*a*, 159*b* can be positioned in at least partial face-to-face contact with respective portions of the attachment panels 131*a*, 131*b* as described above.

As shown in the schematic view of FIG. 4A, in which underlapped panels are illustrated in broken lines for clarity, the locking tabs 144*a* can be separated from the container retention tabs 148*a* at the respective lines of weakening 150*a* and tucked under the attachment panel 131*a* by being at least partially received through the respective openings 142*a* as described above. Similarly, the locking tabs 144*b* can be separated from the container retention tabs 148*b* at the respective lines of weakening 150*b* and inserted at least partially through and received in the respective openings 142*b* to be tucked under the attachment panel 131*b*.

Upon positioning of the top panels 159*a*, 159*b* in at least partial face-to-face contact with respective portions of the respective attachment panels 131*a*, 131*b* as described above, the locking tabs 173*a*, 173*b* can be positioned generally aligned over the respective locking openings 132 interrupting the fold line 112. Accordingly, the locking tabs 173*a*, 173*b* can be folded downwardly at the respective fold lines 175*a*, 175*b* and at least partially inserted through and received in the respective locking openings 132. In such an arrangement, one or more flared or flanged portions of the respective locking tabs 173*a*, 173*b* can engage an underside of one or both of the respective attachment panels 131*a*, 131*b* to maintain a secure engagement of the locking tabs 173*a*, 173*b* through the locking openings 132.

The aforementioned construction of the carrier 205/package 210 can provide a robust and secured engagement of the various panels and portions thereof to support one or more of the containers with advantages similar to those described above with regard to the carrier 105/package 110. In some embodiments, such a construction of the carrier 205/package 210 can be provided so as to avoid or minimize the use of polymeric materials such as adhesives, e.g., glue.

Figure 5:
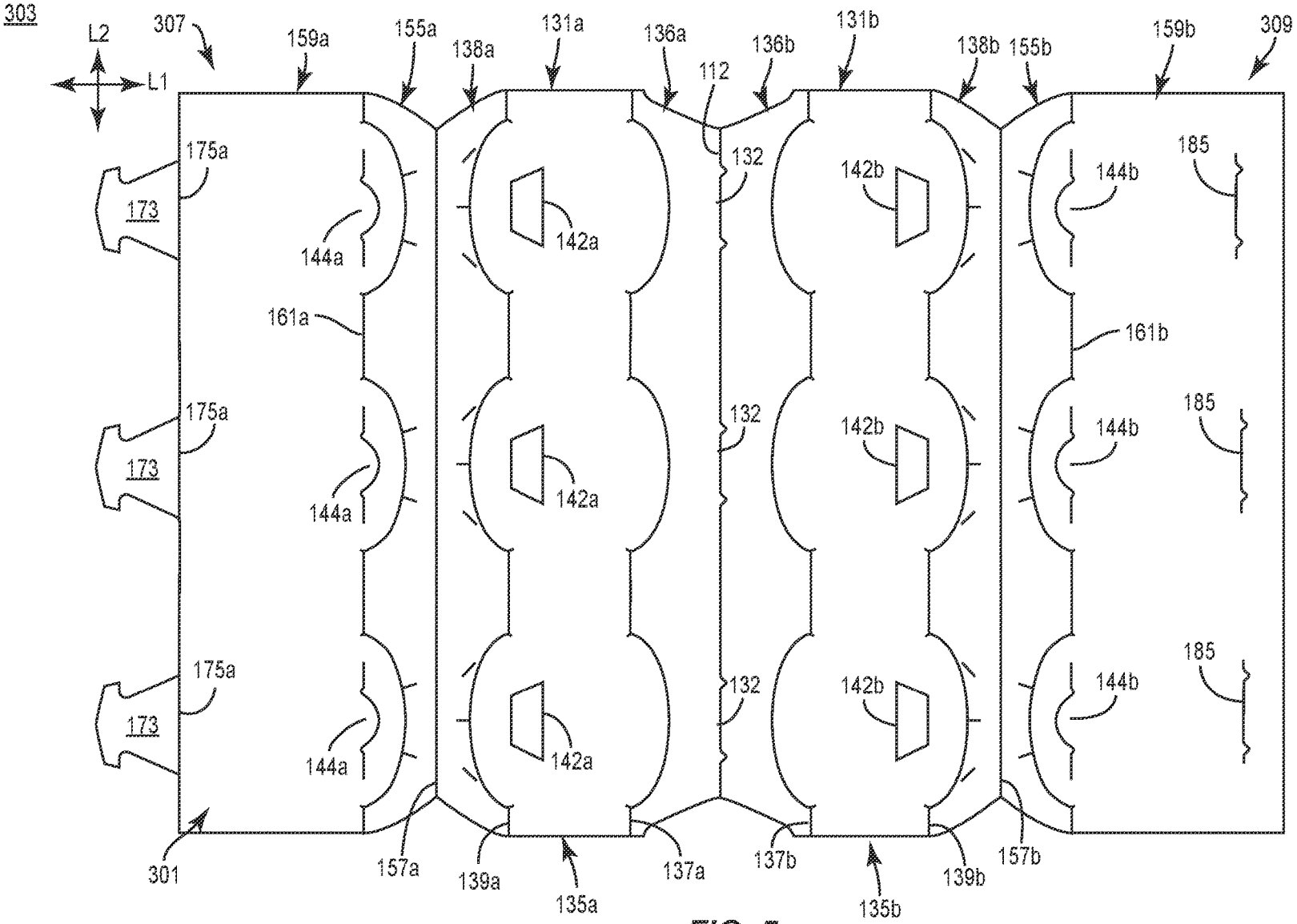
FIG. 5 is a plan view of an outer surface of a blank for forming a carrier and package according to a third exemplary embodiment of the disclosure.

FIG. 5 is a plan view of the exterior surface 301 of a blank 303 for forming a carrier 305 (FIG. 5A) and package 310 (FIG. 5A) according to a third exemplary embodiment of the disclosure. The blank 303 and carrier 305/package 310 formed therefrom can have one or more features that are the same or similar to those described above with respect to the blanks 103, 203 and carriers 105, 205/packages 110, 210 described above, and like or similar features are designated with like or similar reference numerals. Accordingly, the blank 303 can include a front portion 307 for forming a front portion 306 of the carrier 305/package 310 and a back portion 309 for forming a back portion 308 of the carrier 305/package 310.

The blank 303 can have the longitudinal axis L1 and the lateral axis L2, the attachment panels 131*a*, 131*b*, the side panels 155*a*, 155*b*, the top panels 159*a*, 159*b*, and associated features. The blank 303 can also include the locking openings 132, 142*a*, 142*b*, and the locking tabs 144*a*, 144*b*, 173. Additional locking openings 185 (broadly, "female locking features" or "second female locking features" or "fourth female locking features") can be at least partially defined in the back top panel 159*b*. It will be understood that the blank 303/carrier 305/package 310 can have a further different arrangement and/or configuration without departing from the disclosure.

Figure 5A:
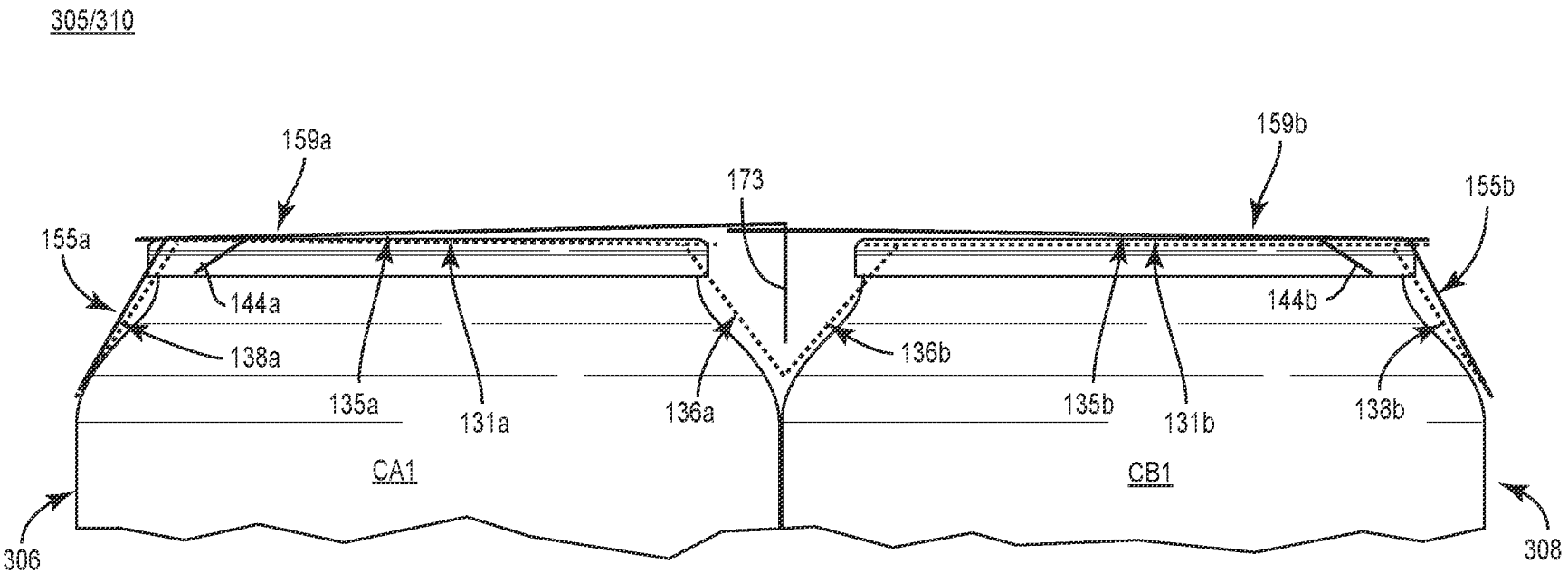
FIG. 5A is a schematic view of a portion of a side of the carrier and package formed from the blank of FIG. 5 according to the third exemplary embodiment of the disclosure.

With additional reference to the schematic view of FIG. 5A, in which underlapped panels are illustrated in broken lines for clarity, the blank 303 can be formed into the carrier 305/package 310 in a manner similar to that described above with regard to the formation of the carriers 105, 205/packages 110, 210 from the blanks 103, 203 as described above. For example, the containers CA1, CA2, CA3, CB1, CB2, CB3 can be at least partially received through openings formed in the respective attachment panels 131*a*, 131*b* via relative folding of one or more portions thereof as described above. The side panels 155*a*, 155*b* can further be positioned in generally oblique relation to respective portions of the attachment panels 131*a*, 131*b* as described above, and the top panels 159*a*, 159*b* can be positioned in at least partial face-to-face contact with respective portions of the attachment panels 131*a*, 131*b* as described above.

The locking tabs 144*a* can be separated from the container retention tabs 148*a* at the respective lines of weakening 150*a* and tucked under the attachment panel 131*a* via at least partial receipt through the respective openings 142*a* as described above. Similarly, the locking tabs 144*b* can be separated from the container retention tabs 148*b* at the respective lines of weakening 150*b* and inserted/received at least partially through the respective openings 142*b* to be tucked under the attachment panel 131*b*.

Upon positioning of the top panels 159*a*, 159*b* in at least partial face-to-face contact with respective portions of the respective attachment panels 131*a*, 131*b* as described above, the locking openings 185 can be positioned generally aligned over the locking openings 132 interrupting the fold line 112, and the locking tabs 173 can be positioned over the aligned locking openings 185, 132. In this regard, the locking tabs 173 can be folded downwardly at the respective fold lines 175, inserted through and received in the locking openings 185, and further inserted at least partially through and received in the locking openings 132. In such an arrangement, one or more flared or flanged portions of the respective locking tabs 173 can engage an underside of one or both of the respective attachment panels 131*a*, 131*b* to maintain a secure engagement of the locking tabs 173 through the locking openings 132.

The aforementioned construction of the carrier 305/package 310 can provide a robust and secured engagement of the various panels and portions thereof to support one or more of the containers with advantages similar to those described above with regard to the carriers 105, 205/packages 110, 210. In some embodiments, such a construction of the carrier 305/package 310 can be provided so as to avoid or minimize the use of polymeric materials such as adhesives, e.g., glue.

Figure 6:
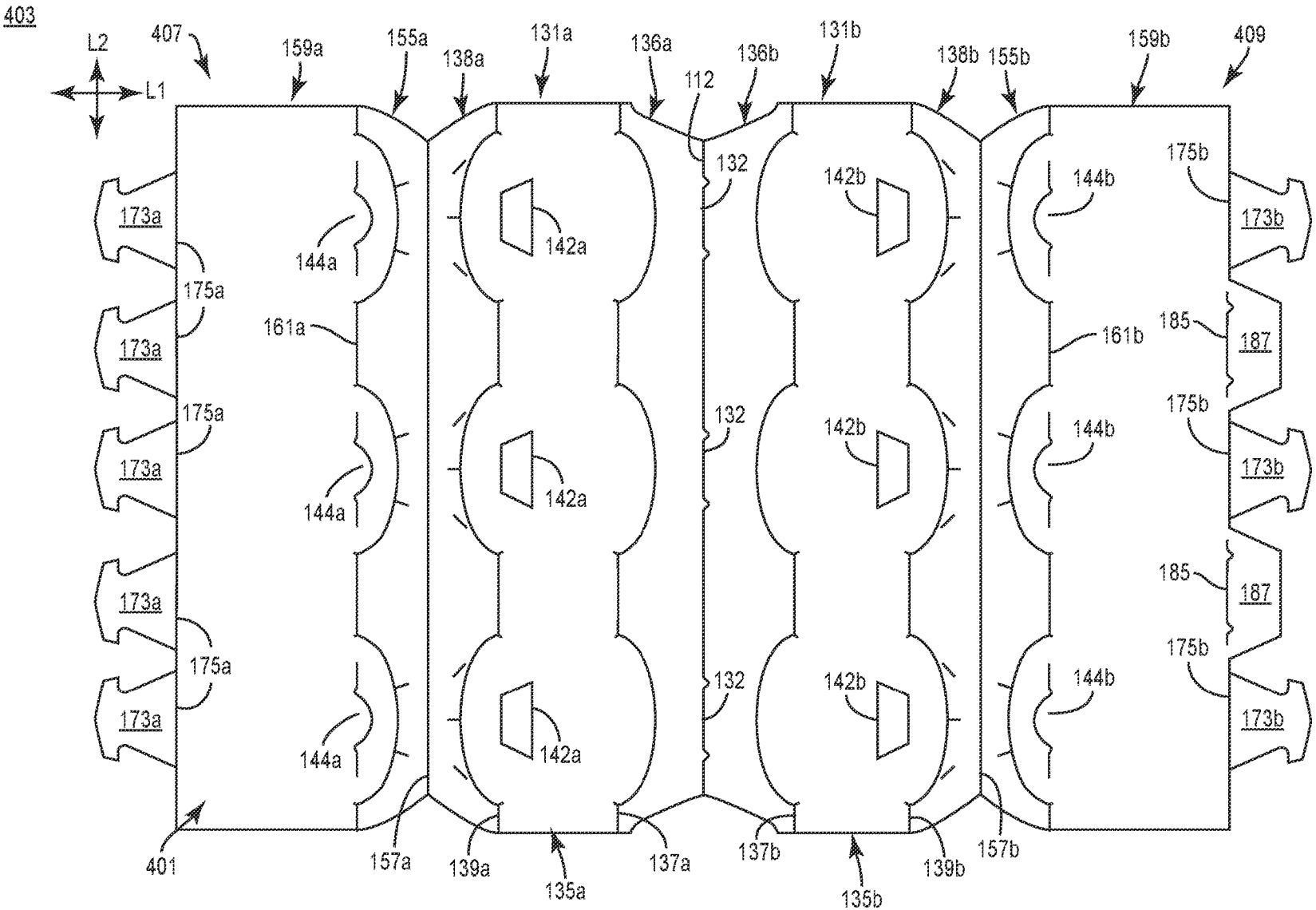
FIG. 6 is a plan view of an outer surface of a blank for forming a carrier and package according to a fourth exemplary embodiment of the disclosure.

FIG. 6 is a plan view of the exterior surface 401 of a blank 403 for forming a carrier 405 (FIG. 6A) and package 410 (FIG. 6A) according to a fourth exemplary embodiment of the disclosure. The blank 403 and carrier 405/package 410 formed therefrom can have one or more features that are the same or similar to those described above with respect to the blanks 103, 203, 303 and carriers 105, 205, 305/packages 110, 210, 310 described above, and like or similar features are designated with like or similar reference numerals. Accordingly, the blank 403 can include a front portion 407 for forming a front portion 406 of the carrier 405/package 410 and a back portion 409 for forming a back portion 408 of the carrier 405/package 410.

The blank 403 can have the longitudinal axis L1 and the lateral axis L2, the attachment panels 131*a*, 131*b*, the side panels 155*a*, 155*b*, the top panels 159*a*, 159*b*, and associated features. The blank 403 can also include the locking openings 132, 142*a*, 142*b*, and the locking tabs 144*a*, 144*b*, 173.

As shown, the locking openings 185 can be at least partially defined at a location along/abutting the top panel 159*b* that is longitudinally spaced further from the central fold line 112 than in the blank 303 described above. In addition, tabs 187 can extend away from the respective locking openings 185 such that the tabs 187 can be at least partially foldably connected to the top panel 159*b* at the respective locking openings 185. In one embodiment, the locking openings 185 can be collinear with a free edge of the top panel 159*b*.

In the illustrated embodiment, the blank 403 can be provided with a greater number of locking tabs 173*a* than in the embodiments described above. In some embodiments, the blank 403 can include 5 locking tabs 173*a*, though a greater or lesser number of locking tabs 173*a* can be provided without departing from the disclosure.

The locking tabs 173*b* can be provided in an alternating arrangement with the tabs 187 such that a respective locking tab 173*b* is generally aligned with a respective locking tab 173*a* along an axis parallel to the longitudinal axis L1, and such that a respective tab 187 is generally aligned with a respective locking tab 173*a* along an axis parallel to the longitudinal axis L1.

Figure 6A:
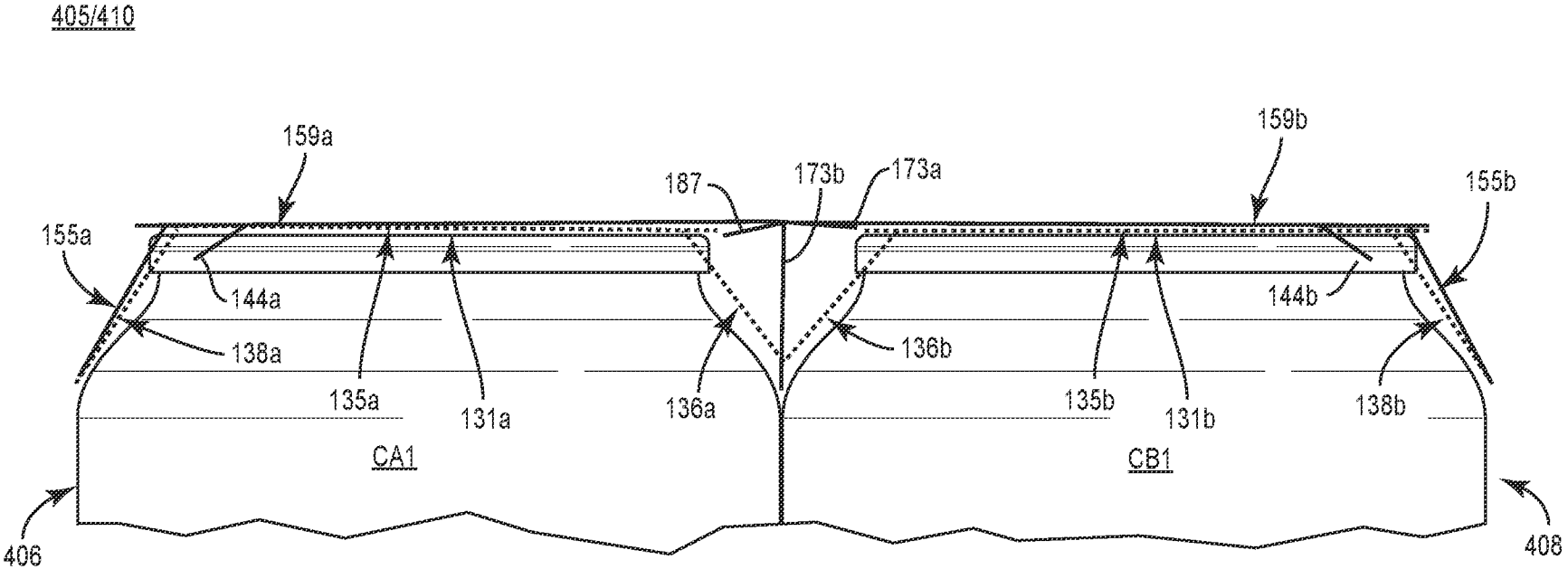
FIG. 6A is a schematic view of a portion of a side of the carrier and package formed from the blank of FIG. 6 according to the fourth exemplary embodiment of the disclosure.

With additional reference to the schematic view of FIG. 6A, in which underlapped panels are illustrated in broken lines for clarity, the blank 403 can be formed into the carrier 405/package 410 in a manner similar to that described above with regard to the formation of the carriers 105, 205, 305/packages 110, 210, 310 from the blanks 103, 203, 303 as described above. For example, the containers CA1, CA2, CA3, CB1, CB2, CB3 can be at least partially received through openings formed in the respective attachment panels 131*a*, 131*b* via relative folding of one or more portions thereof as described above. The side panels 155*a*, 155*b* can further be positioned in generally oblique relation to respective portions of the attachment panels 131*a*, 131*b* as described above, and the top panels 159*a*, 159*b* can be positioned in at least partial face-to-face contact with respective portions of the attachment panels 131*a*, 131*b* as described above.

The locking tabs 144*a* can be separated from the container retention tabs 148*a* at the respective lines of weakening 150*a* and tucked under the attachment panel 131*a* through the respective openings 142*a* as described above. Similarly, the locking tabs 144*b* can be separated from the container retention tabs 148*b* at the respective lines of weakening 150*b* and inserted at least partially through the respective openings 142*b* to be tucked under the attachment panel 131*b*.

Upon positioning of the top panels 159*a*, 159*b* in at least partial face-to-face contact with respective portions of the respective attachment panels 131*a*, 131*b* as described above, some of the locking tabs 173*a*, 173*b* can be generally aligned over the locking openings 132 interrupting the fold line 112, and the locking tabs 173*a* interspersed therebetween can be generally aligned with the tabs 187. In this regard, the locking tabs 173*a*, 173*b* aligned over the locking openings 132 can be folded downwardly at the respective fold lines 175*a*, 175*b* and at least partially inserted through the locking openings 132. In such an arrangement, one or more flared or flanged portions of the respective locking tabs 173*a*, 173*b* can engage an underside of one or both of the respective attachment panels 131*a*, 131*b* to maintain a secure engagement of the locking tabs 173*a*, 173*b* through the locking openings 132.

Furthermore, the locking tabs 173*a* aligned with the respective locking openings 185/tabs 187 can be at least partially inserted through the locking openings 185, for example, to maintain and/or enhance the positioning of the attachment panels 131*a*, 131*b* relative to one another. In some embodiments, the tabs 187 can be at least partially folded downwardly at lines of weakening associated with the tabs 187 to facilitate at least partial receipt of the locking tabs 173*a* in the locking openings 185. In other embodiments, the locking tabs 173*a* can be inserted at least partially through the locking openings 185 and positioned in at least partial face-to-face contact with the tabs 187.

The aforementioned construction of the carrier 405/package 410 can provide a robust and secured engagement of the various panels and portions thereof to support one or more of the containers with advantages similar to those described above with regard to the carriers 105, 205, 305/packages 110, 210, 310. In some embodiments, such a construction of the carrier 405/package 410 can be provided so as to avoid or minimize the use of polymeric materials such as adhesives, e.g., glue.

Figure 7:
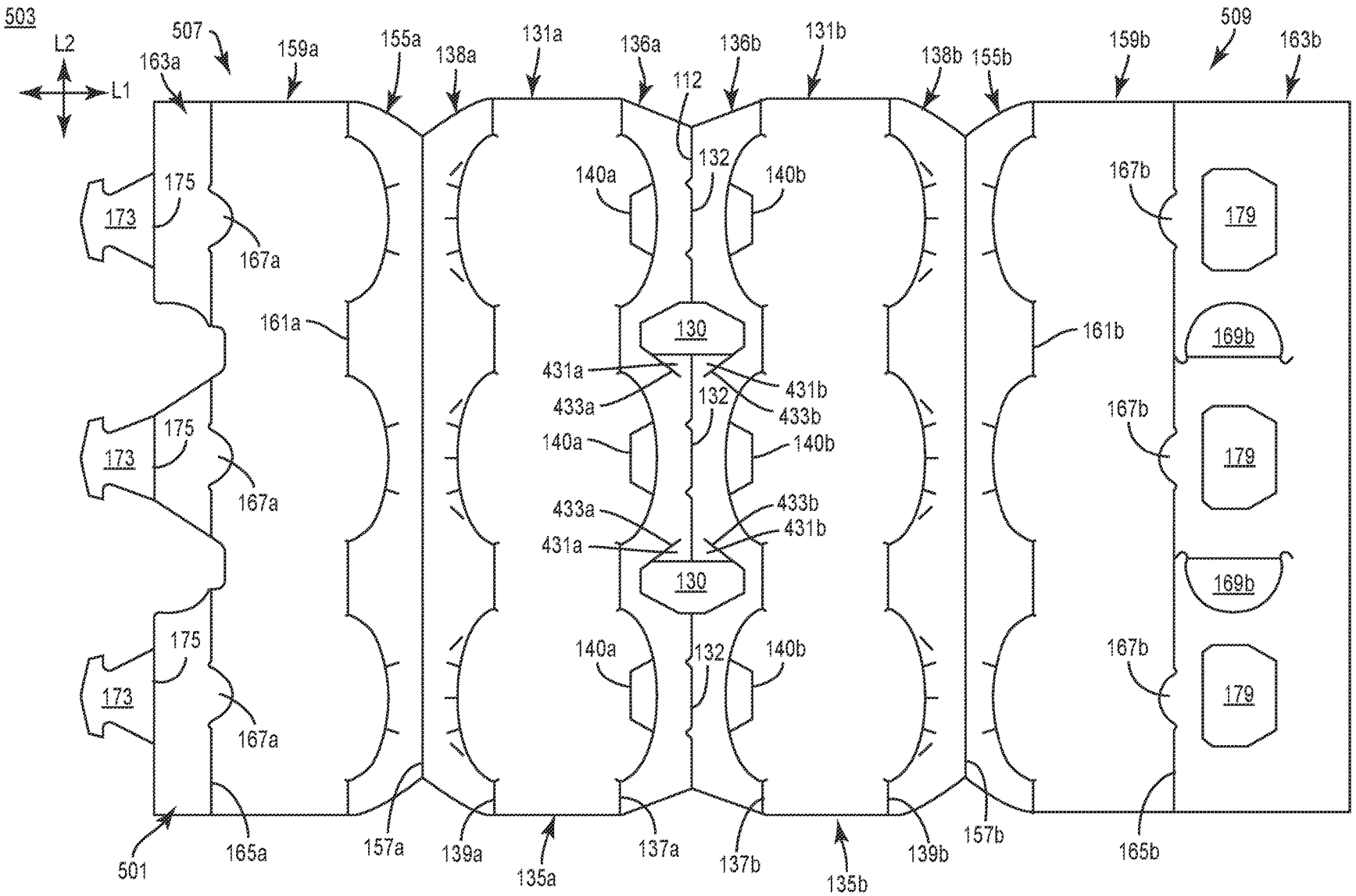
FIG. 7 is a plan view of an outer surface of a blank for forming a carrier and package according to a fifth exemplary embodiment of the disclosure.

FIG. 7 is a plan view of the exterior surface 501 of a blank 503 for forming a carrier 505 (FIG. 7A) and package 410 (FIG. 7A) according to a fifth exemplary embodiment of the disclosure. The blank 503 and carrier 505/package 510 formed therefrom can have one or more features that are the same or similar to those described above with respect to the blanks 103, 203, 303, 403 and carriers 105, 205, 305, 405/packages 110, 210, 310, 410 described above, and like or similar features are designated with like or similar reference numerals. Accordingly, the blank 503 can include a front portion 507 for forming a front portion 506 of the carrier 505/package 510 and a back portion 509 for forming a back portion 508 of the carrier 505/package 510.

The blank 503 can have the longitudinal axis L1 and the lateral axis L2, the attachment panels 131*a*, 131*b*, the side panels 155*a*, 155*b*, the top panels 159*a*, 159*b*, the locking panels 163*a*, 163*b*, and associated features. The blank 503 can also include the locking openings 132, 140*a*, 140*b*, 179, and the locking tabs 167*a*, 167*b*, 173.

As also shown, handle features of the blank 503 can include the handle openings 130, handle reinforcement flaps 431*a*, 431*b* foldably connected to the respective attachment panels 131*a*, 131*b* at respective oblique fold lines 433*a*, 433*b* and positioned extending into the respective handle openings 130, the handle reinforcement flaps 169*b*, and handle notches or handle cutouts 469 formed along a free edge of the locking panel 163*a*.

Figure 7A:
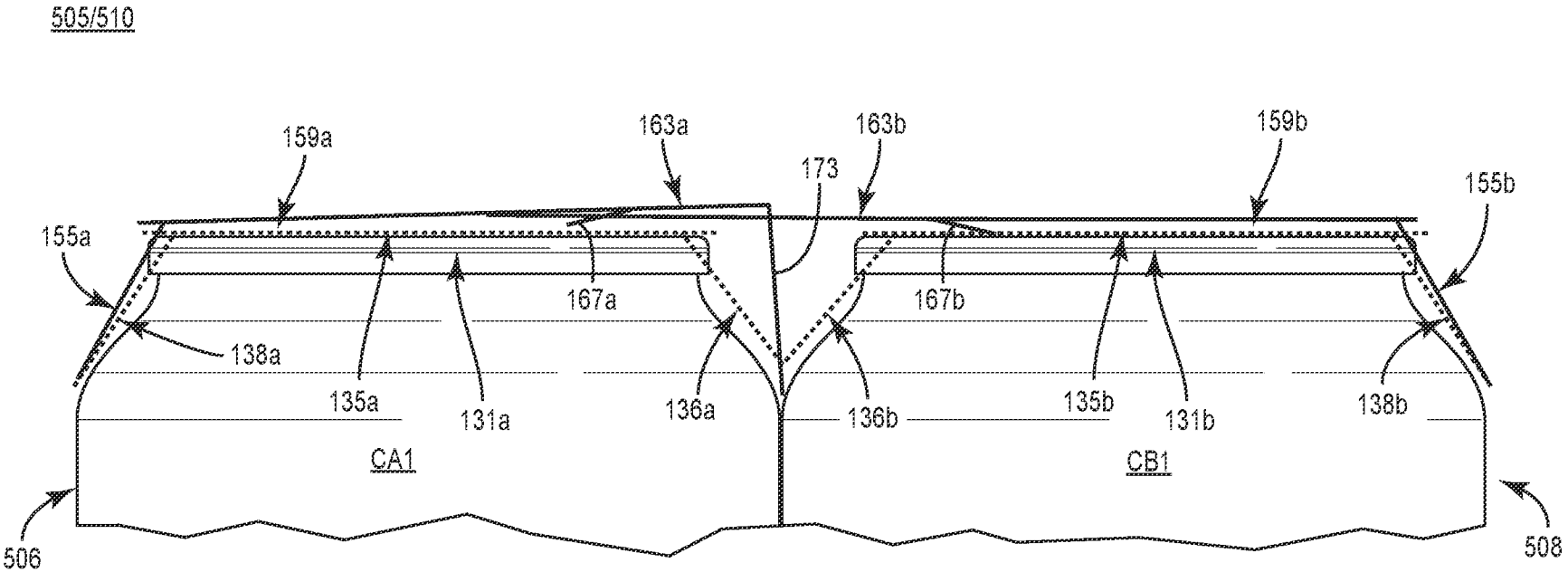
FIG. 7A is a schematic view of a portion of a side of the carrier and package formed from the blank of FIG. 7 according to the fifth exemplary embodiment of the disclosure.

With additional reference to the schematic view of FIG. 7A, in which underlapped panels are illustrated in broken lines for clarity, the blank 503 can be formed into the carrier 505/package 510 in a manner similar to that described above with regard to the formation of the carriers 105, 205, 305, 405/packages 110, 210, 310, 410 from the blanks 103, 203, 303, 403 as described above. For example, the containers CA1, CA2, CA3, CB1, CB2, CB3 can be at least partially received through openings formed in the respective attachment panels 131*a*, 131*b* via relative folding of one or more portions thereof as described above. The side panels 155*a*, 155*b* can further be positioned in generally oblique relation to respective portions of the attachment panels 131*a*, 131*b* as described above, and the top panels 159*a*, 159*b* can be positioned in at least partial face-to-face contact with respective portions of the attachment panels 131*a*, 131*b* as described above.

The locking tabs 167, 167*b* can be separated from the top panels 159*a*, 159*b* at the respective lines of weakening 160*a*, 160*b* and tucked under the attachment panel 131*a* through the respective openings 140*a*, 140*b* as described above.

Upon positioning of the top panels 159*a*, 159*b* in at least partial face-to-face contact with respective portions of the respective attachment panels 131*a*, 131*b* as described above, the locking panel 163*a* can be positioned overlapping the locking panel 163*b*. In this regard, the locking tabs 173 aligned over the locking openings 179, 132 can be folded downwardly at the respective fold lines 175 to be inserted through and received in the respective locking openings 179 and further through the locking openings 132 therebelow. In such an arrangement, one or more flared or flanged portions of the respective locking tabs 173 can engage an underside of one or both of the respective attachment panels 131*a*, 131*b* to maintain a secure engagement of the locking tabs 173 through the locking openings 132.

The above-described arrangement of the panels of the carrier can thus align the various handle features, e.g., the handle openings 469, handle reinforcement flaps 169*b*, and the handle openings 132/handle reinforcement flaps 431*a*, 431*b*, such that a user can at least partially insert one or more of his or her fingers downwardly through the respective handle openings 469, against the reinforcement flaps 169*b* to cause at least partial separation thereof from the respective locking panels 163*b* and downward folding at the respective fold lines 171*a* at least partially through the respective handle openings 130. Such movement of the handle reinforcement flaps 169*b* can cause one or more of the handle reinforcement flaps 431*a*, 431*b* to at least partially fold downwardly at the respective fold lines 433*a*, 433*b* to allow the user to grasp the carrier 505 along portions of the attachment panels 131*a*, 131*b* exposed under the handle openings 130. The reinforcement flaps 169*a*, 169*b*, 433*a*, 433*b* can provide additional plies of material, e.g., as a buffer, between the user's fingers and the carrier, for example, to resist deformation/tearing of one or more portions of the carrier 505, for the user's comfort, to avoid, pinching of the user's fingers, etc.

The aforementioned construction of the carrier 505/package 510 can provide a robust and secured engagement of the various panels and portions thereof to support one or more of the containers with advantages similar to those described above with regard to the carriers 105, 205, 305, 405/packages 110, 210, 310, 410. In some embodiments, such a construction of the carrier 505/package 510 can be provided so as to avoid or minimize the use of polymeric materials such as adhesives, e.g., glue.

Figure 8:
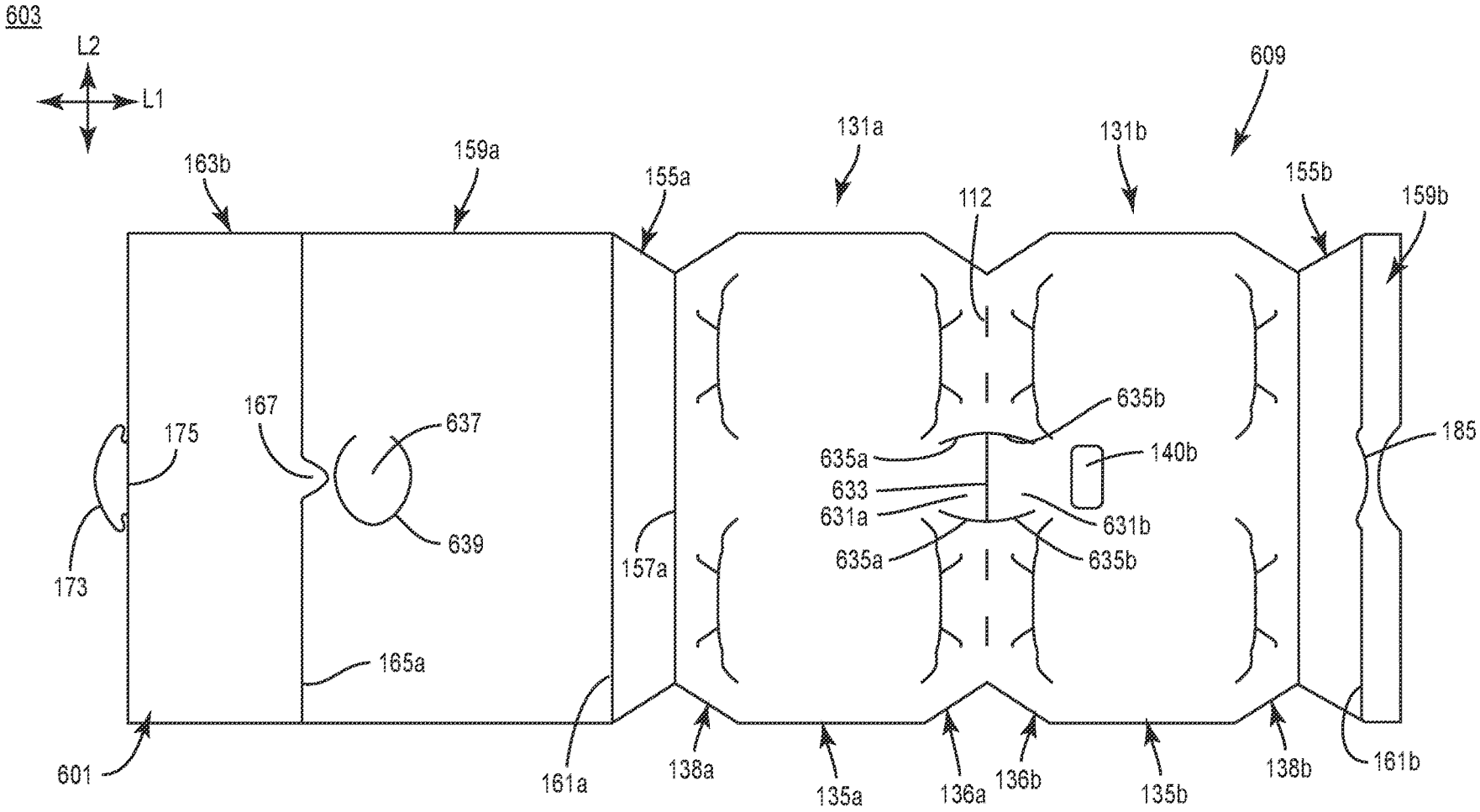
FIG. 8 is a plan view of an outer surface of a blank for forming a carrier and package according to a sixth exemplary embodiment of the disclosure.

FIG. 8 is a plan view of the exterior surface 601 of a blank 603 for forming a carrier 605 (FIG. 8A) and package 610 (FIG. 8A) according to a sixth exemplary embodiment of the disclosure. The blank 603 and carrier 605/package 610 formed therefrom can have one or more features that are the same or similar to those described above with respect to the blanks 103, 203, 303, 403, 503 and carriers 105, 205, 305, 405, 505/packages 110, 210, 310, 410, 510 described above, and like or similar features are designated with like or similar reference numerals. Accordingly, the blank 603 can include a front portion 607 for forming a front portion 606 of the carrier 605/package 610 and a back portion 609 for forming a back portion 608 of the carrier 605/package 610.

The blank 603 can have the longitudinal axis L1 and the lateral axis L2, the attachment panels 131*a*, 131*b*, the side panels 155*a*, 155*b*, the top panels 159*a*, 159*b*, the locking panel 163*a*, and associated features.

The blank 603 can also include a locking tab 167 (broadly, "male locking features" or "first male locking features") interrupting the fold line 161*a*, a locking tab 173, a locking opening 140*b* positioned in the attachment panel 131*b*, and a locking opening 185 positioned interrupting the fold line 161*b*. In the illustrated embodiment, the locking tab 167 can have a generally obliquely-tapered, e.g., wedge-shaped or triangular, configuration, and the locking opening 185 can have a generally curved configuration, though one or both of the locking tab 167 and the locking opening 185 can have a different configuration without departing from the disclosure.

As also shown, handle features of the blank 603 can include a pair of handle reinforcement flaps 631*a*, 631*b* intersecting and separably connected at a longitudinal cut 633 that interrupts the fold line 112. Each handle reinforcement flap 631*a*, 631*b* can be at least partially defined by a respective pair of curved cuts 635*a*, 635*b* intersecting the cut 633. A handle reinforcement flap 637 can also be at least partially defined by a generally curved cut 639 in the top panel 159*a*.

Figure 8A:
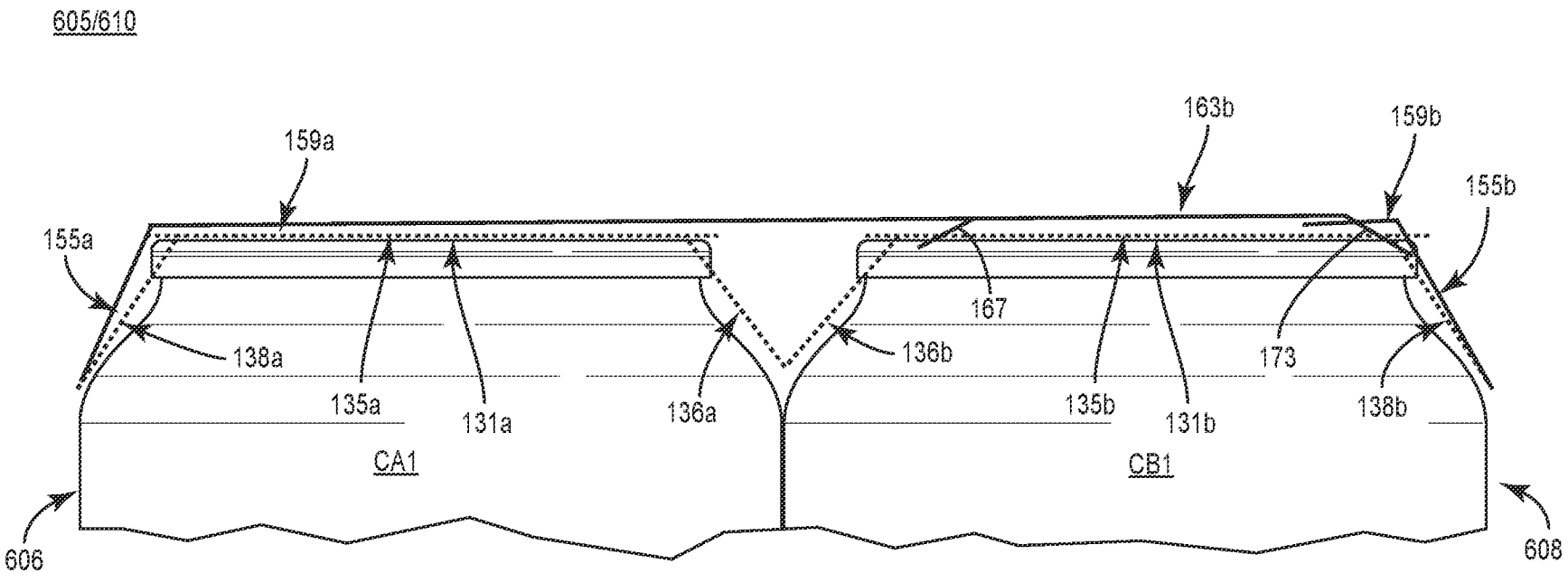
FIG. 8A is a schematic view of a portion of a side of the carrier and package formed from the blank of FIG. 8 according to the sixth exemplary embodiment of the disclosure.

With additional reference to the schematic view of FIG. 8A, in which underlapped panels are illustrated in broken lines for clarity, the blank 603 can be formed into the carrier 605/package 610 in a manner similar to that described above with regard to the formation of the carriers 105, 205, 305, 405, 505/packages 110, 210, 310, 410, 510 from the blanks 103, 203, 303, 403, 503 as described above. For example, the containers CA1, CA2, CA3, CB1, CB2, CB3 can be at least partially received through openings formed in the respective attachment panels 131*a*, 131*b* via relative folding of one or more portions thereof as described above. The side panels 155*a*, 155*b* can further be positioned in generally oblique relation to respective portions of the attachment panels 131*a*, 131*b* as described above, and the top panels 159*a*, 159*b* can be positioned in at least partial face-to-face contact with respective portions of the attachment panels 131*a*, 131*b* as described above.

The locking tab 167 can be separated from the top panel 159*a* at the line of weakening 160 and tucked under the attachment panel 131*b* by being at least partially received through the opening 140*b* as described above. Furthermore, the locking panel 163*a* can be positioned overlapping the top panel 159*b* such that the locking tab 173 can be inserted at least partially through the locking opening 185. In such an arrangement, one or more flared or flanged portions of the locking tab 173 can engage portions of the side panel 155*b* and/or the top panel 159*b* adjacent the locking opening 185.

The above-described arrangement of the panels of the carrier can thus align the various handle features, e.g., the handle reinforcement flaps 637, 631*a*, 631*b*, such that a user can at least partially insert one or more of his or her fingers downwardly through the handle reinforcement flap 637 such that the handle reinforcement flap 637 at least partially separates from the top panel 159*a* at the cut 639 to further move the handle reinforcement flaps 631*a*, 631*b* aligned therebelow to at least partially separate at the cut 633 and from the respective attachment panels 131*a*, 131*b* at the respective cuts 635*a*, 635*b* to move further downwardly to allow the user to grasp the carrier 605 along portions of the attachment panels 131*a*, 131*b* exposed by such movement of the handle reinforcement flaps 631*a*, 631*b*. The handle reinforcement flaps 637, 631*a*, 631*b* can provide additional plies of material, e.g., as a buffer, between the user's fingers and the carrier, for example, to resist deformation/tearing of one or more portions of the carrier 605, for the user's comfort, to avoid, pinching of the user's fingers, etc.

The aforementioned construction of the carrier 605/package 610 can provide a robust and secured engagement of the various panels and portions thereof to support one or more of the containers with advantages similar to those described above with regard to the carriers 105, 205, 305, 405, 505/packages 110, 210, 310, 410, 510. In some embodiments, such a construction of the carrier 605/package 610 can be provided so as to avoid or minimize the use of polymeric materials such as adhesives, e.g., glue.

It will be understood that the blanks and carriers/packages described herein can be provided in different configurations without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising at least one attachment panel configured to receive a portion of one or more containers of the plurality of containers, at least one side panel, and at least one top panel, the at least one attachment panel comprising a container retention portion and at least one marginal portion foldably connected to the container retention portion; and locking features for maintaining an erected configuration of the carrier, the locking features comprising at least one male locking feature extending from a respective panel of the plurality of panels and being at least partially received in a respective at least one female locking feature at least partially defined in a respective panel of the plurality of panels, the at least one female locking feature at least partially defined in the container retention portion of the at least one attachment panel.

2. The carrier of claim 1, wherein the at least one male locking feature is a locking tab and the at least one female locking feature is a locking opening.

3. The carrier of claim 2, wherein the at least one attachment panel is a front attachment panel, the at least one side panel is a front side panel, the at least one top panel is a front top panel, and the plurality of panels further comprises a back attachment panel configured to receive a portion of one or more containers of the plurality of containers, a back side panel, and a back top panel.

4. The carrier of claim 3, wherein the at least one male locking feature is a first male locking feature extending from the front top panel, the at least one female locking feature is a first female locking feature at least partially defined in the front attachment panel, the locking features further comprise a second male locking feature extending from the front top panel, and a second female locking feature at least partially defined between the front attachment panel and the back attachment panel and at least partially receiving the second male locking feature.

5. The carrier of claim 4, wherein the locking features further comprise a third male locking feature extending from the back top panel and at least partially received in a third female locking feature at least partially defined in the back attachment panel.

6. The carrier of claim 5, wherein the locking features further comprising a fourth male locking feature extending from the back top panel and at least partially received in the second female locking feature.

7. The carrier of claim 5, wherein the locking features further comprise a fourth female locking feature at least partially defined in the back top panel, the fourth female locking feature at least partially receiving the second male locking feature.

8. The carrier of claim 7, wherein the fourth female locking feature is aligned with the second female locking feature such that each of the fourth female locking feature and the second female locking feature at least partially receives the second male locking feature therethrough.

9. The carrier of claim 3, wherein the plurality of panels further comprises a front locking panel and a back locking panel, wherein the at least one male locking feature is a first male locking feature extending from the front locking panel and the at least one female locking feature is a first female locking feature at least partially defined in the front attachment panel and at least partially receiving the first male locking feature.

10. The carrier of claim 9, wherein the locking features further comprise a second male locking feature extending from the front locking panel and a second female locking feature at least partially defined between the front attachment panel and the back attachment panel and at least partially receiving the second male locking feature.

11. The carrier of claim 9, wherein the front locking panel is in at least partial face-to-face contact with the back locking panel, the locking features comprise a third female locking feature at least partially defined in the back locking panel, the third female locking feature aligned with the second locking feature such that each of the third female locking feature and the second female locking feature at least partially receives the second male locking feature therethrough.

12. The carrier of claim 11, wherein the third female locking feature is aligned with the first female locking feature such that each of the third female locking feature and the first female locking feature at least partially receive the first male locking feature.

13. The carrier of claim 11, wherein the locking features further comprise a third male locking feature extending from the front top panel and a fourth female locking feature at least partially defined in the front attachment panel and at least partially receiving the third male locking feature.

14. The carrier of claim 13, wherein the locking features further comprise a fifth female locking feature at least partially defined in the back locking panel, the fifth female locking feature aligned with the first female locking feature such that each of the fifth female locking feature and the first female locking feature at least partially receive the third male locking feature therethrough.

15. The carrier of claim 14, wherein the locking features further comprise a fourth male locking feature extending from the front attachment panel and in at least partial face-to-face contact with a portion of the back locking panel.

16. The carrier of claim 15, wherein the locking features further comprise a fifth male locking feature extending from the back locking panel and at least partially received in a sixth female locking feature at least partially defined in the back attachment panel.

17. The carrier of claim 3, wherein the plurality of panels further comprises a front locking panel, wherein the at least one male locking feature is a first male locking feature extending from the front locking panel and the at least one female locking feature is a first female locking feature at least partially defined in the back attachment panel and at least partially receiving the first male locking feature.

18. The carrier of claim 17, wherein the locking features further comprise a second male locking feature extending from the front locking panel and a second female locking feature at least partially defined in the back top panel, the second female locking feature at least partially receiving the second male locking feature, the front locking panel and the back top panel are positioned in at least partial face-to-face contact.

19. A blank for forming a carrier for holding a plurality of containers, the blank comprising:

a plurality of panels comprising at least one attachment panel configured to receive a portion of one or more containers of the plurality of containers, at least one side panel, and at least one top panel, the at least one attachment panel comprising a container retention portion and at least one marginal portion foldably connected to the container retention portion; and locking features for maintaining an erected configuration of the carrier formed from the blank, the locking features comprising at least one male locking feature extending from a respective panel of the plurality of panels for being at least partially received in a respective at least one female locking feature at least partially defined in a respective panel of the plurality of panels when the carrier is formed from the blank, the at least one female locking feature at least partially defined in the container retention portion of the at least one attachment panel.

20. The blank of claim 19, wherein the at least one male locking feature is a locking tab and the at least one female locking feature is a locking opening.

21. The blank of claim 20, wherein the at least one attachment panel is a front attachment panel, the at least one side panel is a front side panel, the at least one top panel is a front top panel, and the plurality of panels further comprises a back attachment panel configured to receive a portion of one or more containers of the plurality of containers, a back side panel, and a back top panel.

22. The blank of claim 21, wherein the at least one male locking feature is a first male locking feature extending from the front top panel, the at least one female locking feature is a first female locking feature at least partially defined in the front attachment panel, the locking features further comprise a second male locking feature extending from the front top panel, and a second female locking feature at least partially defined between the front attachment panel and the back attachment panel for at least partially receiving the second male locking feature when the carrier is formed from the blank.

23. The blank of claim 22, wherein the locking features further comprise a third male locking feature extending from the back top panel for being at least partially received in a third female locking feature at least partially defined in the back attachment panel when the carrier is formed from the blank.

24. The blank of claim 23, wherein the locking features further comprising a fourth male locking feature extending from the back top panel and for being at least partially received in the second female locking feature when the carrier is formed from the blank.

25. The blank of claim 23, wherein the locking features further comprise a fourth female locking feature at least partially defined in the back top panel, the fourth female locking feature for at least partially receiving the second male locking feature when the carrier is formed from the blank.

26. The blank of claim 25, wherein the fourth female locking feature is for being aligned with the second female locking feature such that each of the fourth female locking feature and the second female locking feature are for at least partially receives the second male locking feature therethrough when the carrier is formed from the blank.

27. The blank of claim 21, wherein the plurality of panels further comprises a front locking panel and a back locking panel, wherein the at least one male locking feature is a first male locking feature extending from the front locking panel and the at least one female locking feature is a first female locking feature at least partially defined in the front attachment panel and for at least partially receiving the first male locking feature when the carrier is formed from the blank.

28. The blank of claim 27, wherein the locking features further comprise a second male locking feature extending from the front locking panel and a second female locking feature at least partially defined between the front attachment panel and the back attachment panel and for at least partially receiving the second male locking feature when the carrier is formed from the blank.

29. The blank of claim 27, wherein the locking features comprise a third female locking feature at least partially defined in the back locking panel, the third female locking feature for being aligned with the second locking feature such that each of the third female locking feature and the second female locking feature is for at least partially receives the second male locking feature therethrough when the carrier is formed from the blank.

30. The blank of claim 29, wherein the third female locking feature is for being aligned with the first female locking feature such that each of the third female locking feature and the first female locking feature are for at least partially receive the first male locking feature when the carrier is formed from the blank.

31. The blank of claim 29, wherein the locking features further comprise a third male locking feature extending from the front top panel and a fourth female locking feature at least partially defined in the front attachment panel and for at least partially receiving the third male locking feature when the carrier is formed from the blank.

32. The blank of claim 31, wherein the locking features further comprise a fifth female locking feature at least partially defined in the back locking panel, the fifth female locking feature for being aligned with the first female locking feature such that each of the fifth female locking feature and the first female locking feature are for at least partially receiving the third male locking feature therethrough when the carrier is formed from the blank.

33. The blank of claim 32, wherein the locking features further comprise a fourth male locking feature extending from the front attachment panel and for being in at least partial face-to-face contact with a portion of the back top panel when the carrier is formed from the blank.

34. The blank of claim 33, wherein the locking features further comprise a fifth male locking feature extending from the back locking panel and for being at least partially received in a sixth female locking feature at least partially defined in the back attachment panel when the carrier is formed from the blank.

35. The blank of claim 21, wherein the plurality of panels further comprises a front locking panel, wherein the at least one male locking feature is a first male locking feature extending from the front locking panel and the at least one female locking feature is a first female locking feature at least partially defined in the back attachment panel and for at least partially receiving the first male locking feature when the carrier is formed from the blank.

36. The blank of claim 35, wherein the locking features further comprise a second male locking feature extending from the front locking panel and a second female locking feature at least partially defined in the back top panel, the second female locking feature for at least partially receiving the second male locking feature when the carrier is formed from the blank.

37. A method for forming a carrier for holding a plurality of containers, the method comprising:

obtaining a blank comprising plurality of panels including at least one attachment panel configured to receive a portion of one or more containers of the plurality of containers and comprising a container retention portion and at least one marginal portion foldably connected to the container retention portion, at least one side panel, and at least one top panel, and locking features comprising at least one male locking feature extending from a respective panel of the plurality of panels and at least one female locking feature at least partially defined in a respective panel of the plurality of panels, the at least one female locking feature at least partially defined in the container retention portion of the at least one attachment panel;

positioning the at least one attachment panel for at least partially receiving one or more containers of the plurality of containers; and at least partially inserting the at least one male locking feature through the at least one female locking feature to maintain an erected configuration of the carrier.

38. The method of claim 37, wherein the at least one male locking feature is a locking tab and the at least one female locking feature is a locking opening.

39. The method of claim 38, wherein the at least one attachment panel is a front attachment panel, the at least one side panel is a front side panel, the at least one top panel is a front top panel, and the plurality of panels further comprises a back attachment panel configured to receive a portion of one or more containers of the plurality of containers, a back side panel, and a back top panel.

40. The method of claim 39, wherein the at least one male locking feature is a first male locking feature extending from the front top panel, the at least one female locking feature is a first female locking feature at least partially defined in the front attachment panel, the locking features further comprise a second male locking feature extending from the front top panel, and a second female locking feature at least partially defined between the front attachment panel and the back attachment panel, and the method further comprises at least partially inserting the second male locking feature in the second female locking feature.

41. The method of claim 40, wherein the locking features further comprise a third male locking feature extending from the back top panel and a third female locking feature at least partially defined in the back attachment panel, and the method further comprises at least partially inserting the third male locking feature in the third female locking feature.

42. The method of claim 41, wherein the locking features further comprising a fourth male locking feature extending from the back top panel, and the method further comprises at least partially inserting the fourth male locking feature in the second female locking feature.

43. The method of claim 41, wherein the locking features further comprise a fourth female locking feature at least partially defined in the back top panel, and the method further comprises at least partially inserting the second male locking feature in the fourth female locking feature.

44. The method of claim 43, wherein the method further comprises aligning the fourth female locking feature with the second female locking feature such that each of the fourth female locking feature and the second female locking feature at least partially receives the second male locking feature therethrough.

45. The method of claim 39, wherein the plurality of panels further comprises a front locking panel and a back locking panel, wherein the at least one male locking feature is a first male locking feature extending from the front locking panel, the at least one female locking feature is a first female locking feature at least partially defined in the front attachment panel, and the method further comprises at least partially inserting the first male locking feature in the first female locking feature.

46. The method of claim 45, wherein the locking features further comprise a second male locking feature extending from the front locking panel and a second female locking feature at least partially defined between the front attachment panel and the back attachment panel, and the method further comprises at least partially inserting the second male locking feature in the second female locking feature.

47. The method of claim 45, further comprising positioning the front locking panel is in at least partial face-to-face contact with the back locking panel, the locking features comprise a third female locking feature at least partially defined in the back locking panel, and the method further comprises aligning the third female locking feature with the second locking feature such that each of the third female locking feature and the second female locking feature at least partially receives the second male locking feature therethrough.

48. The method of claim 47, wherein the method further comprises aligning the third female locking feature with the first female locking feature such that each of the third female locking feature and the first female locking feature at least partially receive the first male locking feature.

49. The method of claim 47, wherein the locking features further comprise a third male locking feature extending from the front top panel and a fourth female locking feature at least partially defined in the front attachment panel, and the method further comprises at least partially inserting the third male locking feature in the fourth female locking feature.

50. The method of claim 49, wherein the locking features further comprise a fifth female locking feature at least partially defined in the back locking panel, and the method further comprises aligning the fifth female locking feature with the first female locking feature such that each of the fifth female locking feature and the first female locking feature at least partially receive the third male locking feature therethrough.

51. The method of claim 50, wherein the locking features further comprise a fourth male locking feature extending from the front attachment panel, and the method further comprises positioning the fourth male locking feature in at least partial face-to-face contact with a portion of the back locking panel.

52. The method of claim 51, wherein the locking features further comprise a fifth male locking feature extending from the back locking panel and a sixth female locking feature at least partially defined in the back attachment panel, and the method further comprises at least partially inserting the fifth male locking feature in the sixth female locking feature.

53. The method of claim 39, wherein the plurality of panels further comprises a front locking panel, wherein the at least one male locking feature is a first male locking feature extending from the front locking panel and the at least one female locking feature is a first female locking feature at least partially defined in the back attachment panel, and the method further comprises at least partially inserting the first male locking feature in the first female locking feature.

54. The method of claim 53, wherein the locking features further comprise a second male locking feature extending from the front locking panel and a second female locking feature at least partially defined in the back top panel, the method further comprises positioning the front locking panel and the back top panel in at least partial face-to-face contact, and the method further comprises at least partially inserting the second male locking feature in the second female locking feature.

55. A package, the package comprising:

a plurality of containers; and a carrier holding the plurality of containers, the carrier comprising:

a plurality of panels comprising at least one attachment panel receiving a portion of one or more containers of the plurality of containers, at least one side panel, and at least one top panel, the at least one attachment panel comprising a container retention portion and at least one marginal portion foldably connected to the container retention portion; and locking features maintaining an erected configuration of the carrier, the locking features comprising at least one male locking feature extending from a respective panel of the plurality of panels and being at least partially received in a respective at least one female locking feature at least partially defined in a respective panel of the plurality of panels, the at least one female locking feature at least partially defined in the container retention portion of the at least one attachment panel.

56. The package of claim 55, wherein the at least one male locking feature is a locking tab and the at least one female locking feature is a locking opening.

57. The package of claim 56, wherein the at least one attachment panel is a front attachment panel, the at least one side panel is a front side panel, the at least one top panel is a front top panel, and the plurality of panels further comprises a back attachment panel receiving a portion of one or more containers of the plurality of containers, a back side panel, and a back top panel.

58. The package of claim 57, wherein the at least one male locking feature is a first male locking feature extending from the front top panel, the at least one female locking feature is a first female locking feature at least partially defined in the front attachment panel, the locking features further comprise a second male locking feature extending from the front top panel, and a second female locking feature at least partially defined between the front attachment panel and the back attachment panel and at least partially receiving the second male locking feature.

59. The package of claim 58, wherein the locking features further comprise a third male locking feature extending from the back top panel and at least partially received in a third female locking feature at least partially defined in the back attachment panel.

60. The package of claim 59, wherein the locking features further comprising a fourth male locking feature extending from the back top panel and at least partially received in the second female locking feature.

61. The package of claim 59, wherein the locking features further comprise a fourth female locking feature at least partially defined in the back top panel, the fourth female locking feature at least partially receiving the second male locking feature.

62. The package of claim 61, wherein the fourth female locking feature is aligned with the second female locking feature such that each of the fourth female locking feature and the second female locking feature at least partially receives the second male locking feature therethrough.

63. The package of claim 57, wherein the plurality of panels further comprises a front locking panel and a back locking panel, wherein the at least one male locking feature is a first male locking feature extending from the front locking panel and the at least one female locking feature is a first female locking feature at least partially defined in the front attachment panel and at least partially receiving the first male locking feature.

64. The package of claim 63, wherein the locking features further comprise a second male locking feature extending from the front locking panel and a second female locking feature at least partially defined between the front attachment panel and the back attachment panel and at least partially receiving the second male locking feature.

65. The package of claim 63, wherein the front locking panel is in at least partial face-to-face contact with the back locking panel, the locking features comprise a third female locking feature at least partially defined in the back locking panel, the third female locking feature aligned with the second locking feature such that each of the third female locking feature and the second female locking feature at least partially receives the second male locking feature therethrough.

66. The package of claim 65, wherein the third female locking feature is aligned with the first female locking feature such that each of the third female locking feature and the first female locking feature at least partially receive the first male locking feature.

67. The package of claim 65, wherein the locking features further comprise a third male locking feature extending from the front top panel and a fourth female locking feature at least partially defined in the front attachment panel and at least partially receiving the third male locking feature.

68. The package of claim 67, wherein the locking features further comprise a fifth female locking feature at least partially defined in the back locking panel, the fifth female locking feature aligned with the first female locking feature such that each of the fifth female locking feature and the first female locking feature at least partially receive the third male locking feature therethrough.

69. The package of claim 68, wherein the locking features further comprise a fourth male locking feature extending from the front attachment panel and in at least partial face-to-face contact with a portion of the back locking panel.

70. The package of claim 69, wherein the locking features further comprise a fifth male locking feature extending from the back locking panel and at least partially received in a sixth female locking feature at least partially defined in the back attachment panel.

71. The package of claim 57, wherein the plurality of panels further comprises a front locking panel, wherein the at least one male locking feature is a first male locking feature extending from the front locking panel and the at least one female locking feature is a first female locking feature at least partially defined in the back attachment panel and at least partially receiving the first male locking feature.

72. The package of claim 71, wherein the locking features further comprise a second male locking feature extending from the front locking panel and a second female locking feature at least partially defined in the back top panel, the second female locking feature at least partially receiving the second male locking feature, the front locking panel and the back top panel are positioned in at least partial face-to-face contact.

* * * * *